US006094135A

United States Patent [19]

Sugimoto et al.

[11] Patent Number: 6,094,135

[45] Date of Patent: Jul. 25, 2000

[54] ANTITHEFT SYSTEM AND ANTITHEFT APPARATUS

[75] Inventors: Toshinori Sugimoto; Shuji Maeda; Toshinori Nakamura, all of Mitaka, Japan

[73] Assignee: Secom Co., Ltd., Tokyo, Japan

[21] Appl. No.: 08/898,458

[22] Filed: Jul. 24, 1997

Related U.S. Application Data

[63] Continuation of application No. 08/256,462, filed as application No. PCT/JP93/00792, Jun. 14, 1993, abandoned.

[30] Foreign Application Priority Data

| | | | |
|---|---|---|---|
| Nov. 26, 1992 | [JP] | Japan | 4-316877 |
| Jan. 14, 1993 | [JP] | Japan | 5-005159 |
| Mar. 29, 1993 | [JP] | Japan | 5-070375 |

[51] Int. Cl.[7] ..... G08B 13/00

[52] U.S. Cl. ..... 340/541; 340/426; 340/425.5; 340/628; 379/40

[58] Field of Search ..... 340/541, 426, 340/425.5, 573, 628; 379/40

[56] References Cited

U.S. PATENT DOCUMENTS

| | | | |
|---|---|---|---|
| 4,092,643 | 5/1978 | Stolarczyk | 340/416 |
| 4,642,612 | 2/1987 | Crump | 340/541 |
| 4,646,343 | 2/1987 | Chen | 379/40 |
| 4,764,660 | 8/1988 | Swiatosz . | |
| 4,818,843 | 4/1989 | Swiatosz . | |
| 4,835,514 | 5/1989 | Masegi et al. | 340/426 |
| 4,951,029 | 8/1990 | Severson | 340/506 |
| 5,386,209 | 1/1995 | Thomas | 340/539 |
| 5,394,139 | 2/1995 | Dards | 340/541 |
| 5,398,016 | 3/1995 | Burayez | 340/426 |
| 5,402,000 | 3/1995 | Owens, II | 340/545 |
| 5,424,712 | 6/1995 | Rosenberger | 340/426 |

FOREIGN PATENT DOCUMENTS

| | | |
|---|---|---|
| 2010105 | 8/1990 | Canada . |
| 2 161 378 | 12/1971 | Germany . |
| 57-24680 | 2/1982 | Japan . |
| 57-206995 | 12/1982 | Japan . |
| 59-118087 | 8/1984 | Japan . |
| 62-52046 | 3/1987 | Japan . |
| 61-249809 | 5/1987 | Japan . |
| 62-194376 | 8/1987 | Japan . |
| 4-235339 | 8/1992 | Japan . |
| 4-273736 | 9/1992 | Japan . |
| 4-364598 | 12/1992 | Japan . |
| 5-20582 | 1/1993 | Japan . |
| 5-54272 | 3/1993 | Japan . |
| 5-62088 | 3/1993 | Japan . |
| 2247094 | 2/1992 | United Kingdom . |

*Primary Examiner*—Jeffery A. Hofsass
*Assistant Examiner*—Julie B. Lieu
*Attorney, Agent, or Firm*—Nakaido Marmelstein Murray & Oram LLP

[57] ABSTRACT

A antitheft apparatus for hindering theft by an intruder when the intruder is detected in an alarm mode without operator. In a smoke generation system which is coupled with an alarm system including an intruder detector for detecting an intrusion of an intruder into an monitored area and a mode setter for setting or resetting an alarm state in the monitored area, and which includes a smoke generator for generating smoke inside the monitored area, a antitheft system include smoke generation operation control means for operating the smoke generator in response to the detection signal of the intruder detector when the mode setter sets a mode of the monitored area to an alarm mode without operator, fills the monitored area with smoke, cuts off the field of vision of the intruder and prevent theft and destruction of the intruder, and when the mode setter sets the mode of the monitored area to an alarm mode with an operator inclusive of a resetting mode, this means prevents the operation of the smoke generator 60 due to the detection signal of the intruder detector.

18 Claims, 14 Drawing Sheets

TELEPHONE LINE
80
MONITOR DEVICE
ALARM GENERATION CIRCUIT
41
SMOKE GENERATOR
60
SMOKE GENERATION ACTUATION CIRCUIT
50
56
LOCAL DISPLAY DEVICE
34
BUZZER CIRCUIT
33
DIFFERENTIAL CIRCUIT
35
30
31
32
40
39
38
37
36
55
54
53
51
52
S
Q
R
INTRUDER DETECTOR
20
WARNING
V
NIGHTTIME
RESET
10
ACTIVATION SWITCH
70

INTRUDER DETECTOR
20
WARNING
10
V
RESET
NIGHTTIME
30
31
32
BUZZER CIRCUIT
33
LOCAL DISPLAY DEVICE
34
DIFFERENTIATION CIRCUIT
35
36
37
38
S
Q
R
39
70
ALARM GENERATION CIRCUIT
41
TELEPHONE LINE
MONITOR DEVICE
80
SMOKE GENERATOR
60
SMOKE GENERATION ACTIVATION CIRCUIT
56
54
55
53
51
52
50
SMOKE GENERATION ACTIVATION CIRCUIT
107
103
105
106
104
102
DELAY CIRCUIT
100
101
SMOKE SENSOR
90

ANTITHEFT SYSTEM AND ANTITHEFT APPARATUS

This application is a continuation of Ser. No. 08/256,462 filed Jul. 12, 1994, filed as PCT/JP93/000792 on Jun. 14, 1993 now abandoned.

TECHNICAL FIELD

This invention relates to a system for preventing theft in a secure area such as a bank-vault. More particularly, the present invention relates to a system for subduing an intruder by cutting off his field of vision by utilizing smoke, and which prevents theft.

The present invention relates also to a antitheft apparatus and more particularly, to a antitheft apparatus for preventing theft by cutting off the field of vision of an intruder entering a specific area in the antitheft system described above.

BACKGROUND ART

Apparatuses which generate tear gas or a gas having an offensive odor in a monitored area have been proposed in the past as apparatuses for preventing theft. However, these apparatuses have not been able to control the generation and operation of the gas in a particular gas emission object zone.

These apparatuses have not been put into practical application due to the possibility of gas being generated by erroneous operation, and troublesome exhaust operation after the emission of the gas.

On the other hand, an alarm system for raising an alarm by detecting theft by an intruder in a building has been developed and executed. As objects to be protected have become more widespread in recent years, a more effective management of such an alarm system has become necessary. As to a warning mode, for example, the mode can be divided into a mode for when no people are in the area (MODE 1) and a mode for when people are in the area (MODE 2). It is also possible to set the system to cover only a specific zone.

Such an effective system is also required for the smoke generation alarm system.

As a counter-measure for theft or destruction of money, precious articles, etc, inside buildings, there has been proposed a method which detects an intrusion of moving objects such as people or other animals into a specific area by suitable detection means installed at predetermined positions inside the monitored area, emits a tear gas or a gas having offensive odor into the area so as to generate a situation in which the intruder cannot stay inside the area and to force him to give up his intention and action, and prevents in advance the theft or destruction by forcing the intruder to leave the area.

However, such a tear gas or a gas having offensive odor exterts adverse influences on the human body and leaves particular offensive odor inside the monitored area. Furthermore, the gas offends people entering the area later. Still another problem is that if any exhibitions such as precious articles exist inside the monitored area, the components of the tear gas or the gas having offensive odor adhere to the exhibitions and contaminate them. For these reasons, the method has not yet been put into practical application.

DISCLOSURE OF THE INVENTION

It is therefore a first object of the present invention to provide a useful antitheft system which prevents theft by an intruder only when the intruder is detected in an unattended warning mode of the alarm system.

It is a second object of the present invention to provide a antitheft apparatus capable of preventing theft and destruction of money, precious articles, etc, by solving the problems with the prior art described above, filling the monitored area with smoke or atomized smoke-like gas only when an intruder is in the area so as to cut off his vision and thus depriving him of his free action.

To accomplish the first object described above, the first embodiment of the present invention employs the following construction.

A antitheft system which is coupled with a warning system including an intruder detector for detecting intrusion or destruction by an intruder into or inside a warning alarm, and a mode setter for setting or resetting a warning state of the area, and which generates smoke or atomized smoke-like gas inside the monitored area, includes smoke generation operation means which operates the smoke generator in response to the detection of theft or destruction by the intruder detector when the mode setter sets the mode to Mode 1, and prevents the operation of the smoke generator in response to the detection of the intrusion and destruction by the intruder detector when the mode setter sets the mode to Mode 2.

Note, that the Model 1 is to set an area to be protected to an unattended warning condition, while the Mode 2 is to set an area to be protected to an attended warning condition with reset mode.

To accomplish the second object described above, the second embodiment of the present invention provides a antitheft apparatus employing the following technical construction.

A antitheft apparatus comprising moving object detection means installed inside a secure area, smoke generation means for emitting smoke or atomized smoke-like gas into the monitored area in response to the output of the moving object detection means, and control means for controlling each of the means described above, wherein the smoke generation means has a mechanism which generates smoke by vaporizing a smoke generation substance, for example. In other words, since the present invention has the technical construction described above, the smoke generation means heats and vaporizes the smoke generation substance, which consists of alcohols substantially harmless to the human body as primary components, to generate the atomized smoke, to fill the monitored area with this smoke, to cut off the field of vision of the intruder and to deprive the intruder of his free action. The apparatus of the invention may make it possible to arrest the intruder.

BEST MODE FOR CARRYING OUT THE INVENTION

Hereinafter, a antitheft apparatus and its definite examples according to the first to fourth embodiments of the present invention will be described in detail with reference to the drawings.

Figure 1:
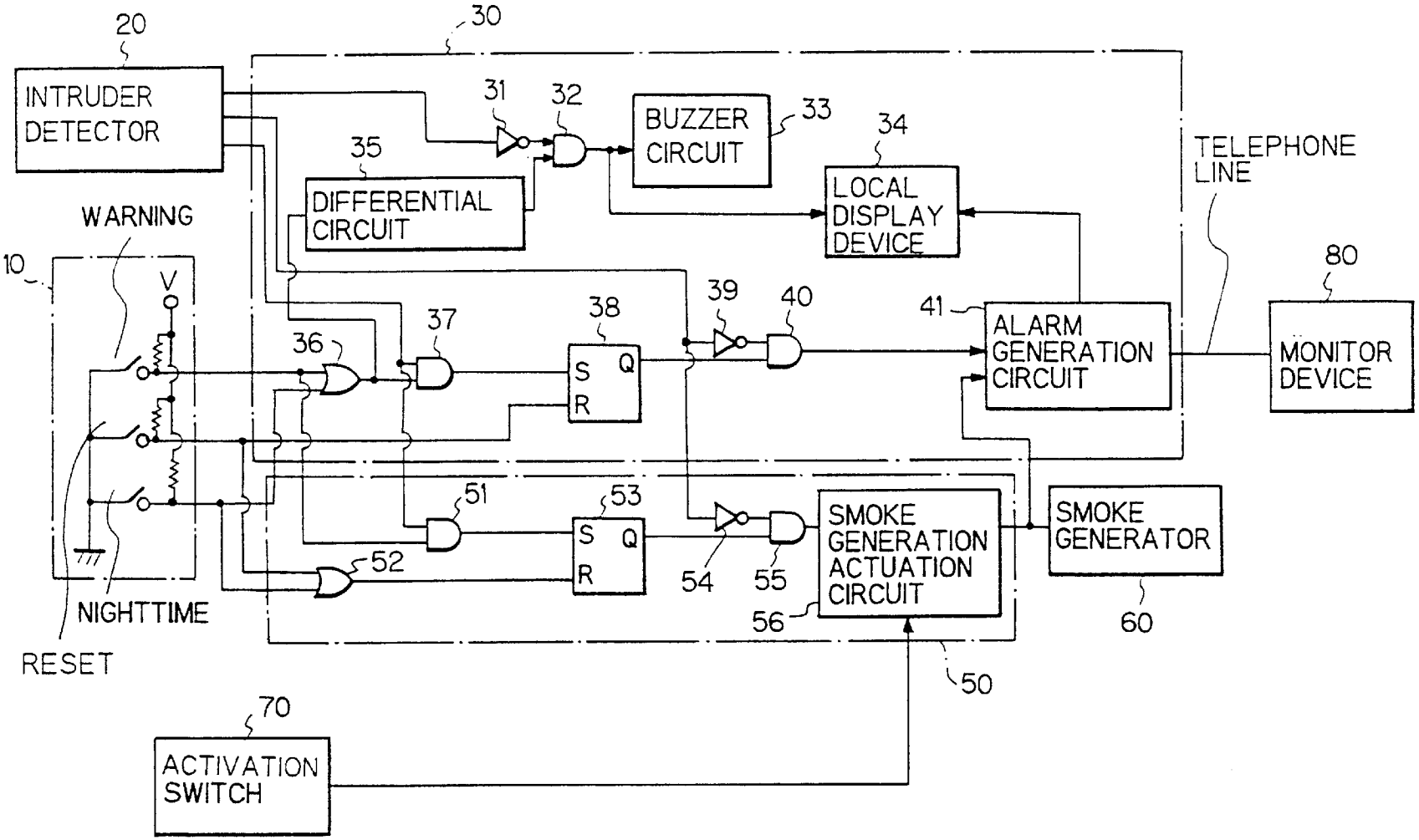
FIG. 1 is a block diagram showing a first definite example of a antitheft system according to a first embodiment of the present invention.

FIG. 1 is a structural block diagram of a antitheft apparatus according to the first embodiment of the present invention.

The antitheft apparatus according to the present invention comprises a mode setter 10, an intruder detector 20, an alarm device 30, a smoke generation actuator 50, a smoke generator 60 and an activation switch 70. This embodiment will be explained about the case where the mode setter 10 is installed outside a monitored area.

The mode setter 10 is connected to the alarm device 30 and to the smoke generation actuator 50, and can set the mode to one of three modes, i.e., a mode in which no person is in the secure area and the state is a warning mode, a release mode in which an operator is in the secure area and therefore, warning is reset and a nighttime mode in which a person is in the secure area and the warning mode is set.

The intruder detector 20 is, for example, a magnet sensor for detecting opening/closing of doors, windows, etc, an infrared sensor for detecting cutoff of infrared by an intruder, and a passive infrared sensor for detecting radiation heat of a human body, etc. This detector 20 is installed on the entrance/exit of the monitored area, walls, windows, etc, and detects opening and closing of the doors and the windows, destruction of the walls, a person inside the secure area, and so forth.

The alarm device 30 includes a first AND gate 32, a first OR gate 36, a second AND gate 37, a first flip-flop 38, a third AND gate 40, a first inverter 31, a second inverter 39, a differentiation circuit 35, a buzzer circuit 33, a local display 34, and an alarm generation circuit 41.

The smoke generation actuator 50 comprises a second OR gate 52, a fourth AND gate 51, a second flip-flop 53, a third inverter 54, a fifth AND gate 55 and a smoke generation activation circuit 56.

The smoke generator 60 generates smoke inside the monitored area by an activation signal from the smoke generation activation circuit 56 or from the activation switch 70.

In case of emergency, the activation switch 70 manually actuates the smoke generation activation circuit 56, irrespective of mode setting by the mode setter 10.

Next, the operation of this embodiment will be explained.

First of all, the case where the monitored area is set to the unattended warning mode will be explained. The person who finally leaves the monitored area first confirms that the intruder detector 20 is not in an erroneous detection state or in other words, that all the doors and windows are normally closed, before he leaves the monitored area. Then, he gets out of the monitored area from a final entrance/exit, not shown in the drawings.

Next, he manipulates and sets the mode setter 10 from the reset mode to the warning mode, which mode setter is installed outside the monitored area.

Due to this manipulation and setting operation, the signal from the mode setter 10 is sent through the first OR gate 36 to the second AND gate 37 and to the differentiation circuit 35, and at the same time, the signal from the mode setter 10 is sent to the fourth AND gate 51.

If the intruder detector 20 is not in the erroneous intruder detection state or in other words, if it is in the normal state, the signal level of this intruder detector 20 is kept at a high level, and its signal is sent to the first inverter 31, the second inverter 39, the third inverter 54 and the second and fourth AND gates 37 and 51.

If the intruder detector 20 is under any erroneous intruder detection state such as the existence of any window which is accidentally left open, its signal level is low. Accordingly, a signal "1" is first sent to the first AND gate 32 through the first inverter 31, so that the two input terminals of the first AND gate 32 become "1" and a logical output appears at its output terminal, thereby actuating the buzzer circuit 33 to ring a buzzer. In other words, the existence of any intruder of the monitored area is automatically inspected at the point of time when the mode setter 10 is set to the warning mode, and setting of the warning mode while the erroneous intruder state remains is notified at once to the person finally leaving the monitored area so that he can re-set the warning mode.

If the erroneous intruder detection state does not exist, the two input terminals of the second AND gate 37 become "1" as is obvious from the explanation given above, and the logical output appears at the output terminal.

In this instance, no output is generated at the output terminal of the first AND gate 32. Accordingly, the buzzer circuit 33 and the local display 34 are not actuated.

On the other hand, if the erroneous intruder detection state does not exist when the warning mode is set by the mode setter 10, the signal is set to the set terminal S of the first flip-flop 38 and the output of its output terminal Q is kept continuously. The output of this first flip-flop 38 is continuously inputted to one of the input terminals of the third AND gate 40.

Signal application is made to the set terminal S of the second flip-flop 53, and the output of its output terminal Q is kept continuously.

The output of this second flip-flop 53 is continuously inputted to one of the input terminals of the fifth AND gate 55.

Next, the explanation will be given on the case were an intruder enters the monitored area when the mode is set to the unattended warning mode as described above.

The output of the first flip-flop 38 is continuously inputted to one of the input terminals of the third AND gate 40. Since the signal from the intruder detector 20 is inputted to the other input terminal of this third AND gate 40 through the second inverter 39, the signal applied to the third AND gate 40 through the second inverter 39 reaches the "1" level when any intruder is detected by the intruder detector 20 in this warning mode. Accordingly, when any intruder is detected during the warning mode, the third AND gate 40 produces a logical output at its output terminal and activates the alarm generation circuit 41, and this alarm generation circuit 41 sends an alarm signal to a remote monitor 80 through a communication line such as a telephone line.

The signal from the intruder detector 20 is also applied to the other input terminal of the fifth AND gate 55 through the third inverter 54. Therefore, if any intruder is detected by the intruder detector 20 during the warning mode, the signal applied to the fifth AND gate 55 through the third inverter 54 reaches the "1" level. In consequence, when any intruder is detected during the warning mode, the fifth AND gate 55 produces a logical output terminal and activates the smoke generation activation circuit 56.

The smoke generation activation circuit 56 actuates the smoke generator 60 and sends a signal to the alarm generation circuit 41, and the alarm generation circuit 41 sends a signal representing the activation of smoke generation to the monitor device 80 in Alarm center through the communication line such as the telephone line.

The smoke generator 60 is installed inside the monitored area. Receiving the activation signal from the smoke generation actuator 50, this smoke generator 60 automatically ignites and generates smoke by the activation signal.

Smoke thus jetted immediately fills the monitored area and cuts off the field of vision of the intruder.

Since his field of vision is cut off as described above, the intruder cannot continue actions such as theft and destruction inside the monitored area.

When those who are permitted in advance to enter the area know of this intrusion, they can actuate the smoke generator 60 through the smoke generation activation circuit 56 by manually operating the actuator switch 70.

Next, the mode changing operation will be explained hereunder, in which the reset mode is changed to the nighttime mode, i.e., the warning mode with an operator.

The person who first enters the monitored area operates the mode setter 10, consisting of a ten-key pad or other switching device and sets the mode to the resetting mode.

This resetting operation applies the signal from the mode setter 10 to the reset terminal R of each of the first and second flip-flops 38 and 53, and the output of the output terminal Q of each flip-flop is stopped. The outputs of the first and second flip-flops 38 and 53 fall to the low level to one of the input terminals of the third and fifth AND gates 40 and 55. For this reason, even when the signal from the intruder detector 20 is inputted to the other input terminal of each of the second and fifth AND gates 40 and 55, no signal is outputted at this output terminal.

Accordingly, the alarm generation circuit 41 and the smoke generation activation circuit 56 are not operated.

Next, setting the mode from the resetting mode to the night mode in which warning state with operator will be explained.

In the security system, there are the case where the mode is set to the warning system in the nighttime even though some persons be present, and the case where a guard or guards are always stationed in the nighttime so as to guard the doors, windows, etc, depending on the monitored area.

Under such a manned state, the smoke generator 60 is prevented from activation even when the intruder detector 20 detects any intruder.

When the mode is set to the nighttime mode, the signal of the mode setter 10 is inputted to the second AND gate 37 through the first OR gate 36. The operations of the second AND gate 37 and of the first flip-flop 38 are the same as those in the warning mode. If any window is open, the alarm is outputted but the smoke generation activation circuit 56 is not operated.

The second definite example of the antitheft apparatus according to the first embodiment of the present invention will be explained with reference to FIG. 2.

Figure 2:
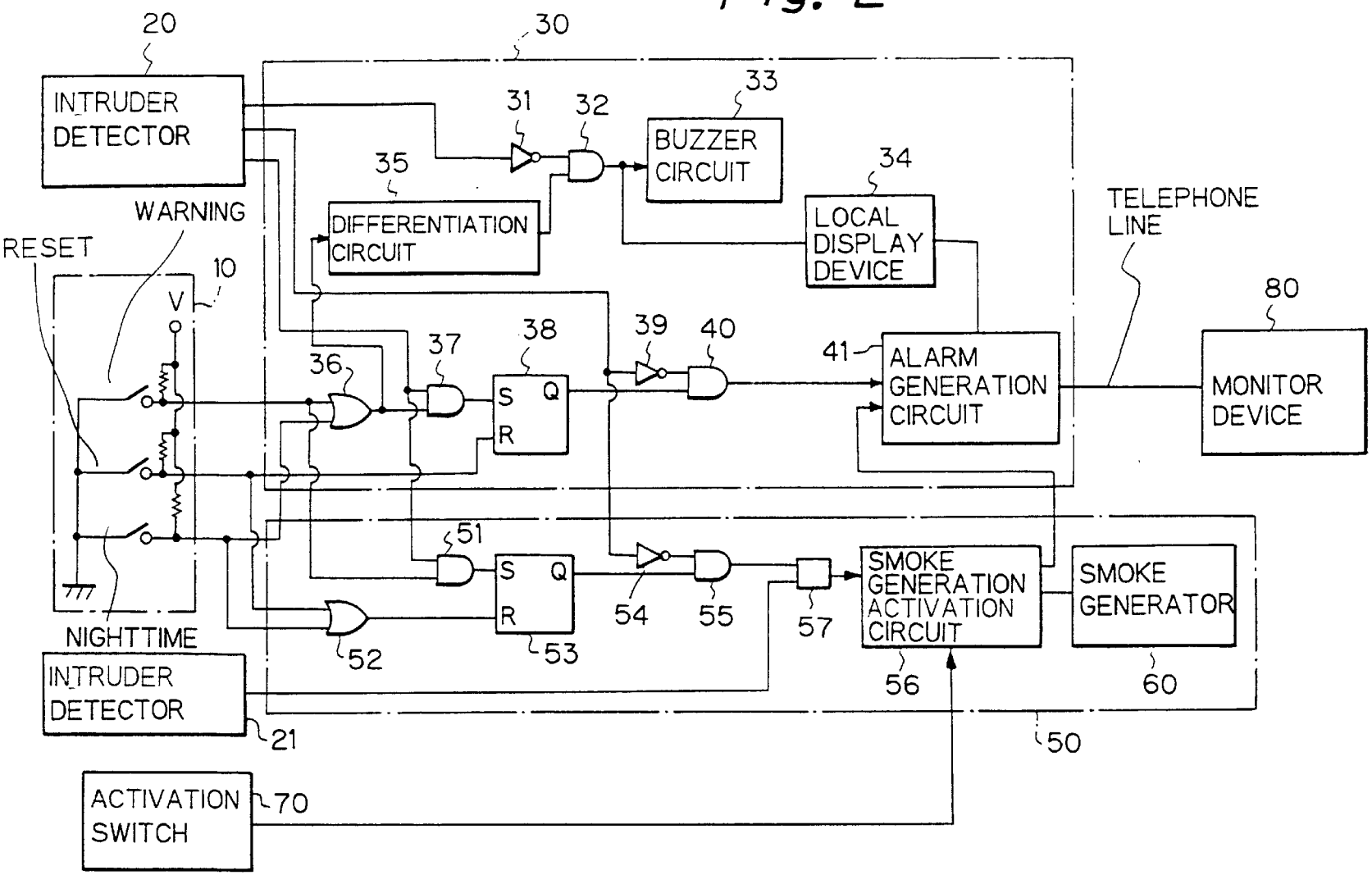
FIG. 2 is a block diagram showing a second definite example of the antitheft system according to the first embodiment of the present invention.

In FIG. 2, like reference numerals are used to identify like devices or circuit elements as in FIG. 1.

By the way, in this example, a particularly important zone such as a vault is arranged to be inside the monitored area.

In this embodiment, each of the second intruder detector 21 and the smoke generation activator 50 each includes a hold circuit 57.

The second intruder detector 21 installed inside an important zone such as a vault inside the monitored area, and detects trespass or existence of an intruder into or inside the important zone.

The operations such as setting of the warning mode are the same as those shown in FIG. 1.

When any intruder intrudes into the monitored area in this warning mode, the intrusion signal from the third AND gate 40 is applied to the alarm generation circuit 41 in the same way as described already, and the alarm is sent to the monitor device 80 through the telephone line. At this point of time, however, the output of the fifth AND gate 55 is input to, and held by, the hold means 57 and the smoke generation activation circuit 56 is not operated. This hold means 57 holds the signal for a predetermined time such as five minutes.

If the intruder intrudes into the important zone within this predetermined period, the second intruder detector 21 detects this intrusion and applies the signal to the hold means 57. When the signal from the intruder detector 21 is inputted to the hold means 57 while it holds the signal from the fifth AND gate 55, it outputs the signal to the smoke generation activation circuit 56. The smoke generation activation circuit 56 lets the smoke generator 60 generate smoke and cut off the field of vision of the intruder. In other words, in this embodiment, the generation of smoke is effected only in the important zone so as to prevent the generation of smoke due to the erroneous operation of the intruder detector 20 and to provide a more effective antitheft apparatus for the important zone.

By the way, the route of the intruder can be distinguished and the reliability of the generation of smoke can be improved by using the intruder detector 20 for detecting intrusion into the monitored area, the second intruder detector 21 for detecting intrusion into the important zone, or by using the intruder detector 20 for detecting intrusion into the monitored area and the second intruder detector 21 for detecting the existence of any intruder in the monitored area.

The third definite example of the antitheft apparatus according to the first embodiment of the present invention will be explained with reference to FIG. 3.

Figure 3:
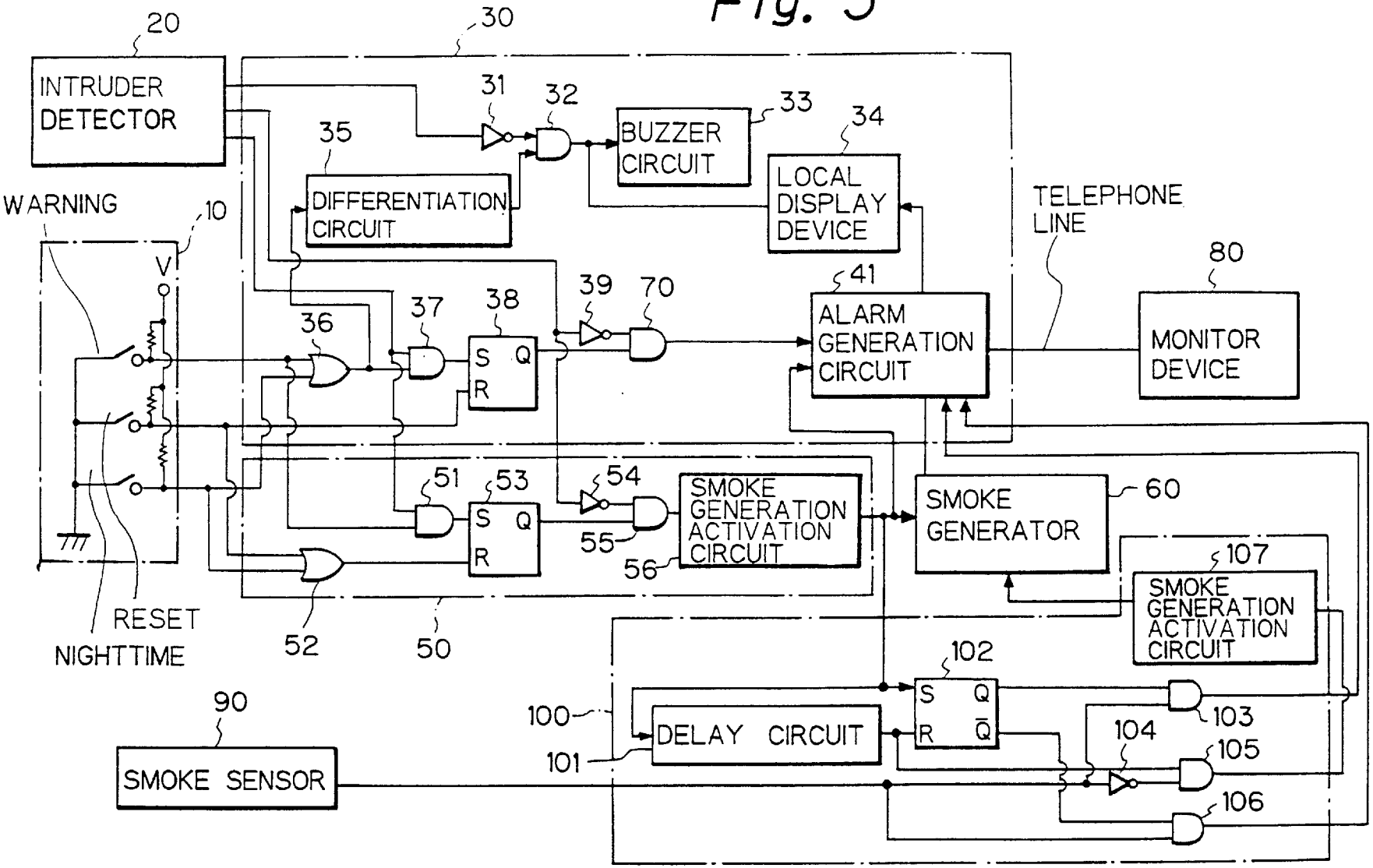
FIG. 3 is a block diagram showing a third definite example of the antitheft system according to the first embodiment of the present invention.

FIG. 3 is a structural block diagram of the antitheft apparatus which confirms the activation of the smoke generator 60 and actuates once again the smoke generator in the event that the smoke generator does not operate.

In FIG. 3, like reference numerals will be used to identify like devices or circuit elements as in FIG. 1.

The antitheft apparatus of this embodiment includes a smoke sensor 90 and a smoke generation confirmation device 100.

The smoke sensor 90 is installed inside the monitored area, is of a photoelectric or ion type, and detects smoke inside the monitored area.

The smoke generation confirmation device 100 comprises a delay circuit 101, a third flip-flop 102, a sixth AND gate 103, a fourth inverter 104, a seventh AND gate 105, an eighth AND gate 106 and a second smoke generation activation circuit 107.

Next, the operation will be explained.

The setting operation to each of the warning mode, the release mode and the nighttime mode is the same as that of the first embodiment. The explanation will be hereby given on the case where the mode is set to the warning mode.

When the intruder intrudes into the monitored area while the mode is set to the warning mode, the smoke generation activation circuit 56 is operated as described above and actuates the smoke generator 60. At the same time, the smoke generation activation signal is inputted to the delay circuit 101 and the set terminal S of the third flip-flop 102 of the smoke generation activation confirmation device 100.

The output of the output terminal Q of the third flip-flop 102 is continuously inputted to one of the terminals of the sixth AND gate 103. Here, when the smoke generator 60 normally operates due to the activation signal from the smoke generation activation circuit 56, smoke is generated inside the monitored area. Sensing this smoke, the smoke sensor 90 sends a signal to the other input terminal of the sixth AND gate 103. Here, the two input terminals of the sixth AND gate 103 become "1" and its output becomes "1". This output is inputted as the smoke generation confirmation signal to the alarm generation circuit 41 and is sent to the monitor device 80.

Next, the explanation will be given in the case where the smoke generator 60 does not operate even when the smoke generation activation circuit 56 starts its operation after the intruder enters into the monitored area.

The activation signal from the smoke generation activation circuit 56 is inputted to the smoke generator 60 and to the delay circuit 101 and the set terminal S of the third flip-flop 102 of the smoke generation confirmation device 100.

Receiving the signal from the smoke generation activation circuit 56, the delay circuit 101 delays it by a predetermined time such as 60 seconds, and inputs the signal to the reset terminal R of the third flip-flop 102 and to one of the input terminals of the seventh AND gate 105. Here, if smoke is not generated by some reason or other even after 60 seconds' time passes from the activation of smoke generation, the smoke sensor 90 naturally does not sense smoke. Accordingly, the signal of the "1" level is inputted to the other input terminal of the seventh AND gate 105 through the fourth inverter 104, and the signal is outputted from the output terminal of the seventh AND gate. This signal is inputted to the second smoke generation activation circuit 107, and activates once again the smoke generator 60.

Here, the smoke generator 60 to be again activated may be installed separately.

Further, if the remote monitor 80 does not receive the smoke generation confirmation signal even though it receives the alarm signal, the smoke generator 60 may be activated directly by a reception circuit, not shown in the drawing, through the telephone line.

Next, if the smoke sensor 90 senses smoke even when the intruder does not intrude into the monitored area or in other words, when the smoke generator 60 does not operate, the output from the Q bar terminal of the third flip-flop 102 is inputted to one of the input terminals of the eighth AND gate 106, and the signal from the smoke generator 90 is inputted to the other input terminal of the eighth AND gate 106. Accordingly, the output of the eighth AND gate 106 becomes "1" and this AND gate sends the signal to the alarm generation circuit 41, so that the alarm generation circuit 41 displays fire on the local display and sends a fire signal to the remote monitor.

Though the definite example given above explains the example of the confirmation of smoke generation by the smoke sensor 90, the present invention is not limited thereto. For example, the smoke generator itself may be provided with the smoke generation confirmation means. For instance, a temperature sensor is installed inside the smoke generator so as to detect heat at the time of the generation of smoke. Alternatively, burn-out of an ignition heater for the activation of the smoke generation is detected by disconnection of the circuit.

Next, the fourth definite example of the first embodiment of the present invention, which warns the intruder before the activation of the smoke generator 60, will be explained with reference to FIGS. 4 and 5.

Figure 4:
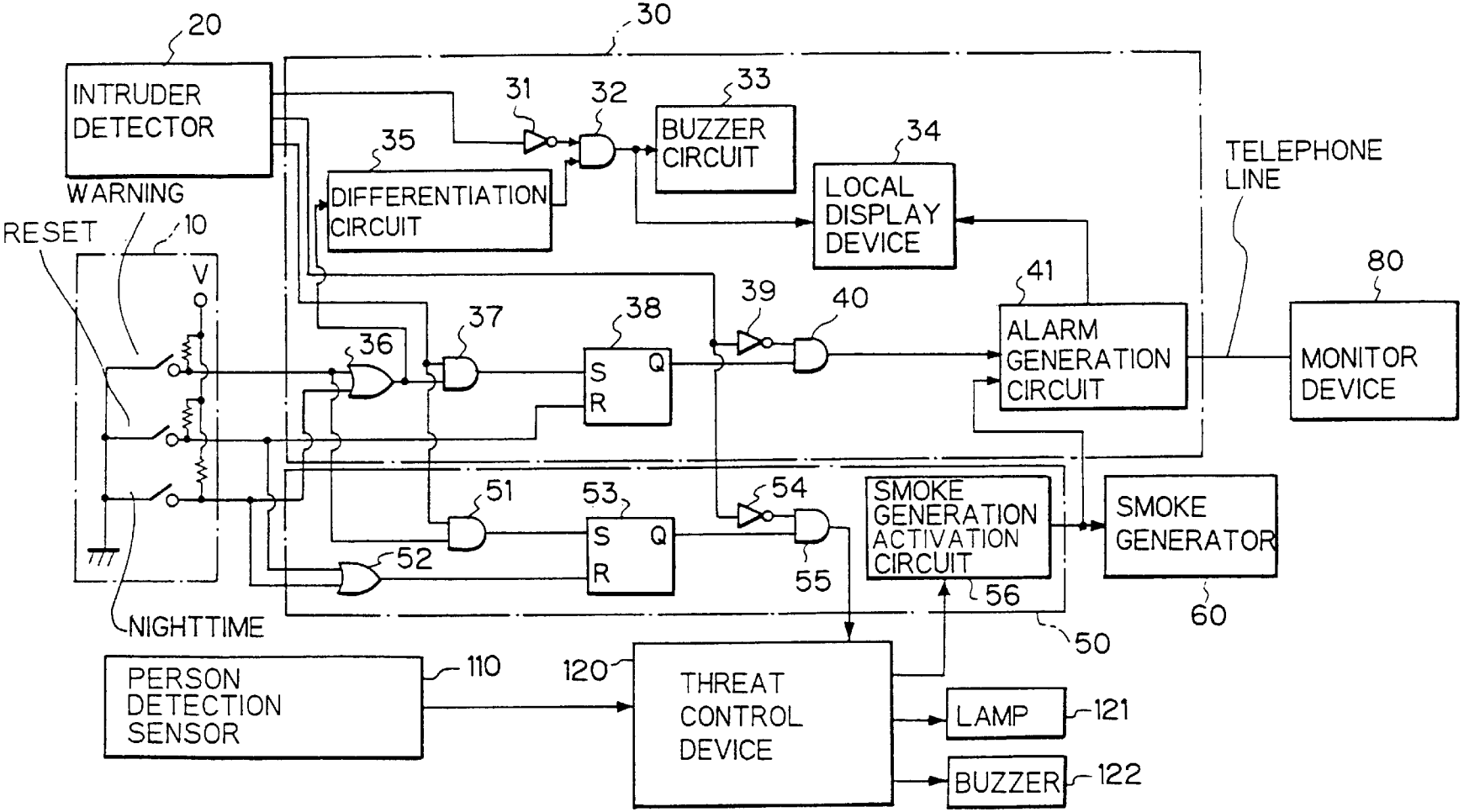
FIG. 4 is a block diagram showing a fourth definite example of the antitheft system according to the first embodiment of the present invention.
Figure 5:
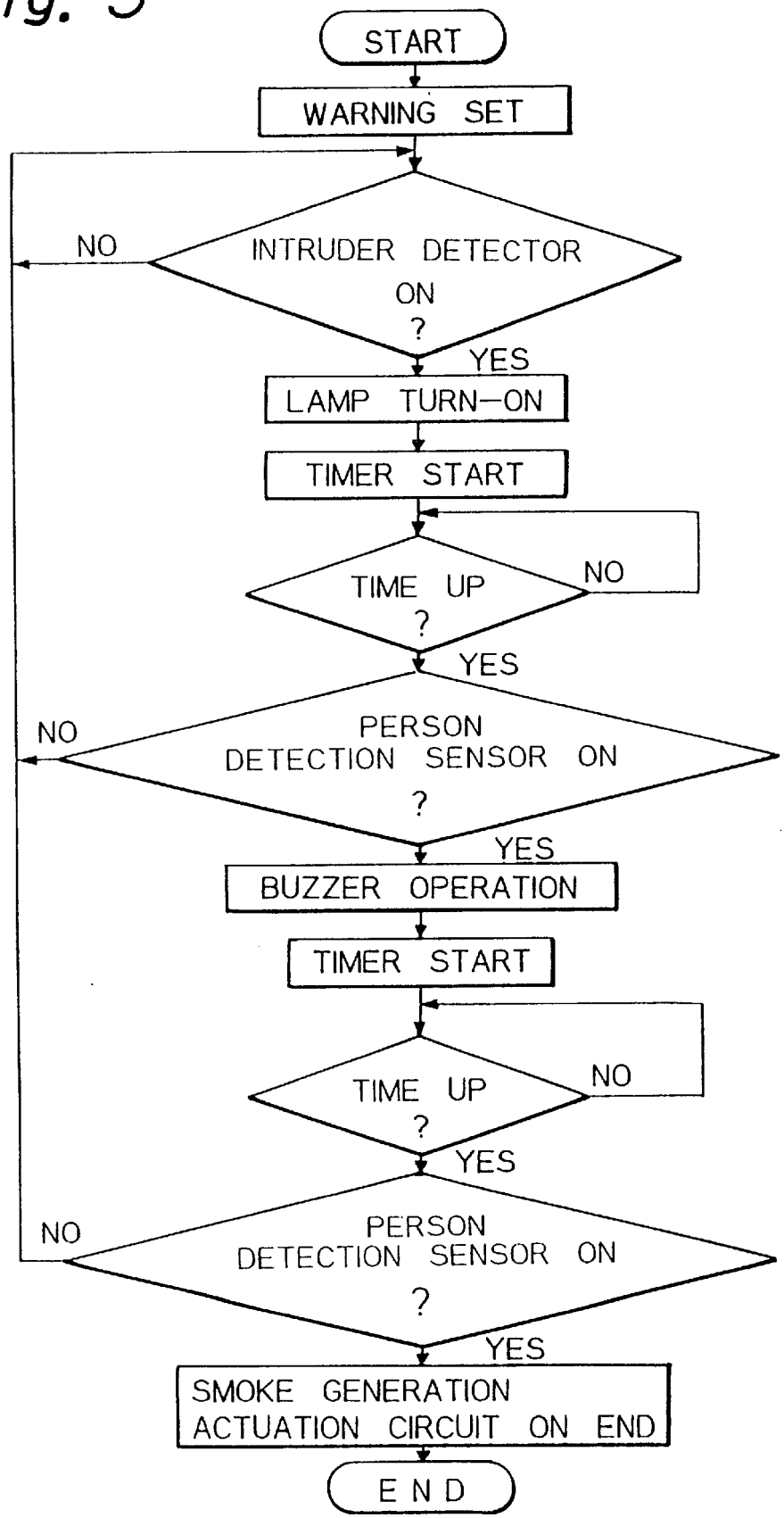
FIG. 5 is a flowchart of a smoke generation system in the definite example of the present invention shown in FIG. 4.

In FIG. 4, like reference numerals will be used to identify like devices or circuit elements as in FIG. 1.

Reference numeral 110 denotes a detector for detecting whether or not any intruder exists inside the monitored area. The resident retrieval sensor 110 is, for example, a passive infrared sensor, an ultrasonic sensor, and so forth.

Reference numeral 120 denotes a warning controller, which controls lamps, buzzers, etc, for warning the intruder inside the monitored area.

The lamp 121 is lit or turned on and off under the control of the warning controller 120, and warns the intruder.

The buzzer 122 buzzes under the control of the warning controller 120 and warns the intruder.

Next, the operation of this definite example will be explained with reference to the flowchart shown in FIG. 5. The operation before the monitored area is set to the warning mode is the same as that of the first embodiment. When the intruder detector 20 detects the intruder under this warning mode, the output of the fifth AND gate 55 is inputted to the warning controller 120 (Step 2).

The warning controller 120 turns on the lamps 121 (Step 3).

The warning controller 120 actuates a timer, not shown (Step 4), and lets the sensor 110 for detecting whether or not any person exists inside the monitored area after the passage of a predetermined time counted by this timer (Steps 5 and 6).

If the intruder leave the monitored area after the lighting of the lamps 121, the state returns to the state of Step 2.

If the intruder does not leave the monitored area after the lighting of the lamps 121, the controller 120 actuates the buzzer 122 (Step 7). The timer, not shown, counts the time and after the passage of the predetermined time, the sensor 110 for detecting the person inside the monitored area is again actuated to check any person (Steps 8, 9 and 10).

If the intruder gets out of the monitored area after the operation of the buzzer 122, the state returns to the state of Step 2, and this state is held until the mode is set to the resetting mode or to the nighttime mode. Resetting is done when the mode is set to the release mode or to the nighttime mode.

When the intruder still remains inside the monitored area, the smoke generation activation circuit 56 is actuated (Step 11). This smoke generation activation circuit activates the smoke generator 60 and at the same time, inputs the smoke generation signal to the alarm generation circuit 41.

Though the intruder sensor 20 and the resident retrieval sensor 110 have been explained as the separate sensors in this embodiment, they may be the same sensor.

Next, the fifth definite example of the first embodiment of the present invention, wherein a resetting device is installed inside the monitored area, will be explained with reference to FIG. 6.

Figure 6:
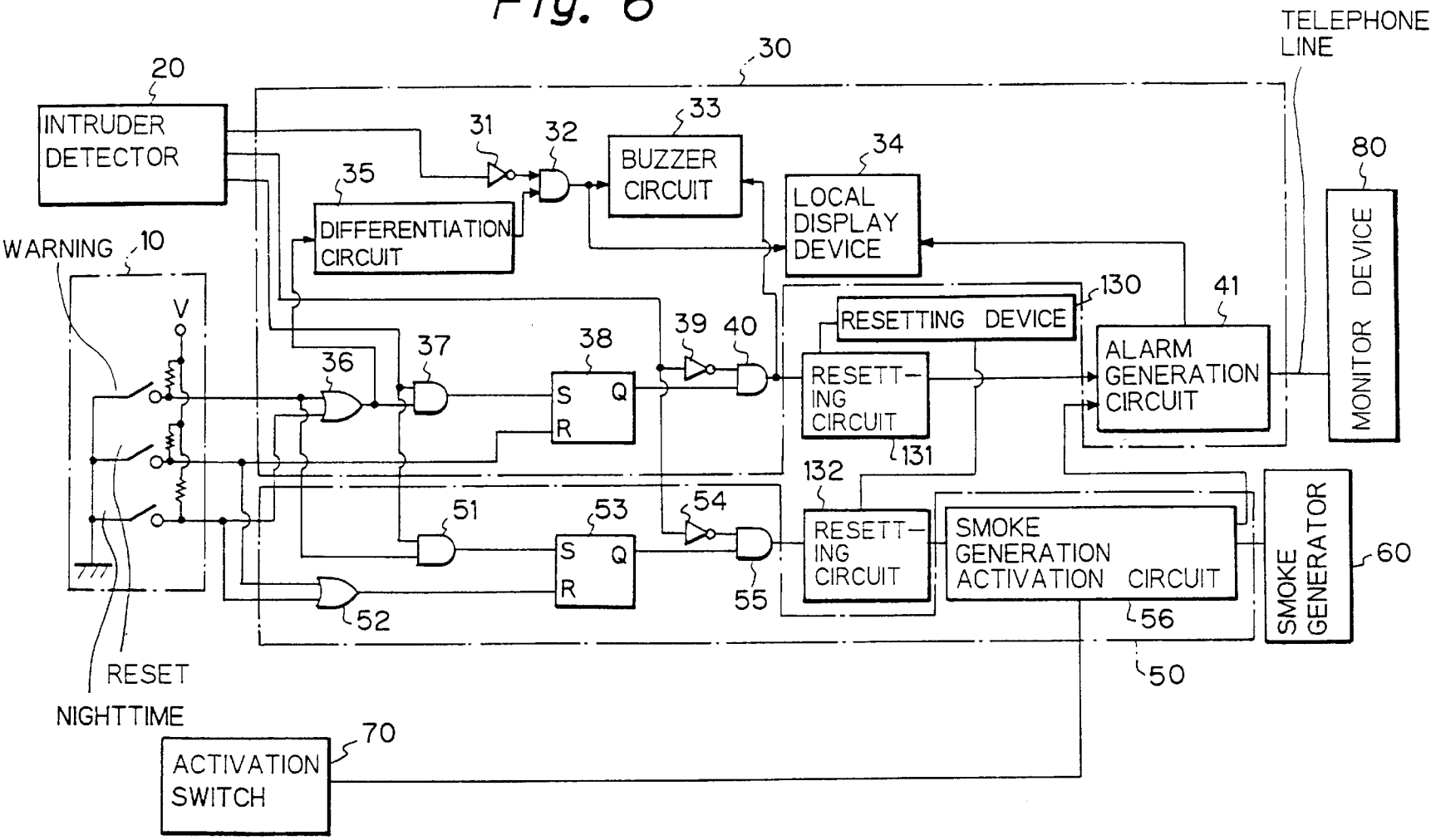
FIG. 6 is a block diagram showing a fifth definite example of the antitheft system according to the first embodiment of the present invention.

In FIG. 6, like reference numerals will be used to identify like devices or circuit elements as in FIG. 1.

Reference numeral 130 denotes resetting device installed inside the monitored area. The release device comprises a magnetic card reader or a tenkey input device, for example, checks qualification of an operator and effects the resetting operation.

Reference numerals 131 and 132 denote resetting circuits, which hold the outputs of the third and fifth AND gates 40 and 55 for a predetermined time, and cancels the alarm generation and the smoke generation by the input of the resetting signal from the resetting device 130 within the predetermined time.

Next, the operation will be explained below.

The set operation of the warning mode of the monitored area is the same as that of the first definite example.

If a person forgets to change the warning mode to the release mode by the mode setter and enters the monitored area, the intruder detector 20 detects intruder and the outputs are produced from the third and fifth AND gates 40 and 55 in the same way as described above. The output of the third AND gate 40 is inputted to the release circuit 131 and to the buzzer circuit 33. The output of the fifth AND gate 55 is inputted to the release circuit 132.

Here, the release circuits 131 and 132 hold the inputted signals for a predetermined time such as 30 seconds.

Since the buzzer circuit 33 buzzes, the entering person realizes that he has forgotten to operate the mode setter 10, and makes the resetting operation by the use of the resetting device 130. This resetting operation is carried out, for example, by inserting a magnetic card, registered in advance, into the magnetic card reader.

In this way, the qualification check of the person qualified to operate the release device 130 is made so that the intruder cannot reset the warning mode.

When the entering person effects the resetting operation within the predetermined time described above, the release circuits 131 and 132 cancel the signals they have held. Accordingly, the generation of the alarm and smoke can be prevented by a qualified person in the monitored area.

If an unqualified person enters the monitored area, he cannot naturally operate the resetting device 130, so that smoke is generated and the alarm is transmitted to the monitor device 80 through the communication line such as the telephone line, after the passage of the predetermined time.

The alarm generation circuit 41 may be provided with the reception means and the smoke generation activation means so that the smoke generator can be activated by remote control from the monitor device 80.

Though the smoke generator is installed inside the monitored area in the embodiment described above, it is also possible to dispose the smoke generator outside the monitored area and to introduce smoke to the floors or walls of the monitored area through pipes, or the like.

A plurality of introduction portions may be installed in accordance with the quantity of smoke generated.

In the definite example described above, smoke is automatically jetted and cuts off the field of vision of the intruder even when the intruder enters into the monitored area.

The first to fifth definite examples described above use the smoke generator which generates smoke upon combustion, but this is not limitative, in particular. For example, a smoke generation substance such as an alcohol may be heated for vaporization and be jetted in the atomized state.

The antitheft apparatus of the present invention can also be applied to an object for which the warning mode is set under the state where qualified persons are in the area, and smoke is not generated. Accordingly, the qualified persons are not prevented from free action due to the generation of smoke.

Next, the antitheft apparatus according to the second embodiment of the present invention will be explained in detail with reference to definite examples thereof shown in the drawings.

Figure 7:
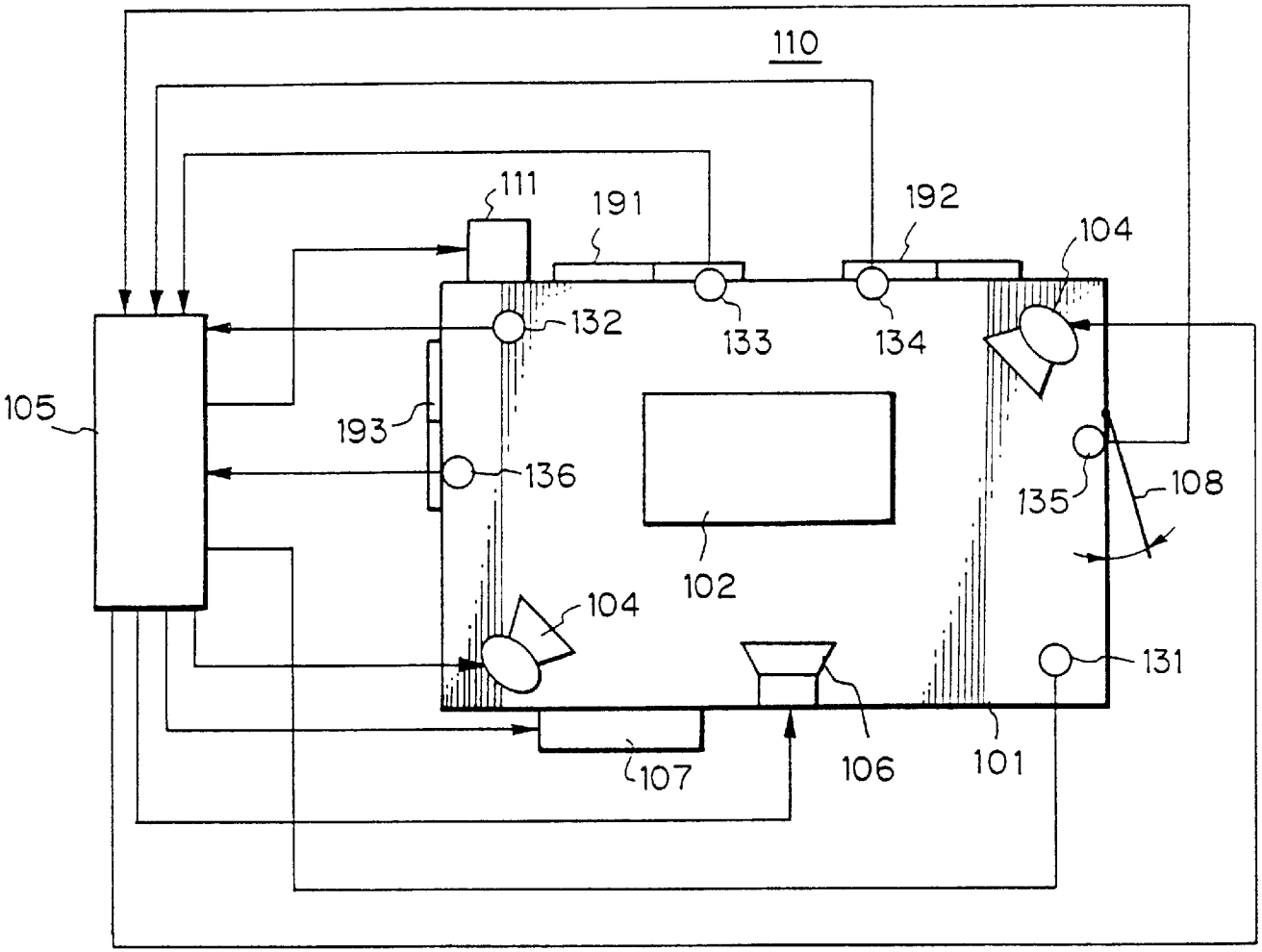
FIG. 7 is a block diagram showing a definite example of a antitheft apparatus used in the antitheft system according to a second embodiment of the present invention.

FIG. 7 is an explanatory view useful for explaining the construction of a definite example of the antitheft apparatus according to the second embodiment of the present invention. The drawing shows a antitheft apparatus 110 which is installed inside the monitored area 101 and which comprises moving object detection means 131 and 132, smoke generation means 104 for jetting atomized smoke (hereinafter called merely "smoke") into the monitored area in response to the output of the moving object detection means, and control means 105 for controlling each of these means.

A zone 102 in which a monitored object such as a safe, an automatic cash dispenser, expensive merchandise such as precious metals, arts and crafts such as paintings, etc, is installed inside the monitored area 101 of the present invention. Quite naturally, entrance/exit 108 for people or animals as the moving objects and windows 191 to 193 are installed in this monitored area 101, and heretofore known antitheft sensors are installed in these entrance/exit 108 and the windows 191 to 193. When any of the entrance/exit 108 and the windows 191 to 193 is opened or closed in the warning mode, or when at least a part of any of the entrance/exit 108 and the windows 191 to 193 is destroyed, these sensors determine it any intruder enters the monitored area and transmits data from the monitored area to the control means 105 installed at a remote place from, or in the proximity of, the monitored area, so as to drive the alarm 111.

In other words, in the definite example of the present invention described above, the moving object sensor means 131, 132 detect the entrance of the moving object into the monitored area 101 and transmit the data to the control means 105, and the control means 105 transmits the driving signal for driving the predetermined smoke generation means 104 to this means 104 so that this smoke generation means 104 can generate smoke.

The number of the moving object detection means 131, 132 used in the present invention and the positions of their installation are not limited, in particular, and the number and positions of the installation of the moving object detection means 131, 132 can be set so that the detection of the intruder can be made without any dead space inside the monitored area 101.

The construction itself of the moving object detection means 131, 132 is not particularly limited, either, and known moving object detectors using a medium such as an ultrasonic wave, an infrared ray, a laser, magnetic force, etc, can be used.

In the antitheft apparatus according to the present invention, the moving object detection means 131, 132 and the known antitheft sensors 133, 134, 135, 136, etc, installed at the entrance/exit 108 or in the windows 191 to 193, etc, may be so arranged as to operate in the interlocking arrangement with one another. More definitely, a later-appearing smoke generation means 104 may be so constituted as to operate when at least one of the antitheft sensors 133, 134, 135, 136 and at least one of the moving object detection means 131, 132 output the data representing the detection of the entrance of the intruder.

Furthermore, in the present invention, the moving object detection means 131, 132 may be installed around the monitored area 101 so that when the moving object detection means detect the approach of the intruder to the monitored area, it is filled beforehand with smoke.

The smoke generation means 104 used in the present invention preferably uses a gas which does not exert any adverse influences on the human body and does not permit any remaining gas inside the monitored area 101 but can quickly generate smoke and fill the monitored area 101 with this smoke, in place of the tear gas or the offensive odor gas that has been employed in the past. Further, this smoke has preferably a high concentration, can completely cut off the field of vision of the intruder from the valuable articles inside the monitored area, and thus can prevent the intruder from destroying the articles or carrying them out from the monitored area 101.

The smoke generation substance used for the smoke generation means of the present invention preferably uses an alcoholic component as its primary material, and more definitely, preferably comprises a dihydric alcoholic component.

An example of the smoke generation substance capable of efficiently generating smoke by appropriate vaporization in the present invention is a mixture of tripropylene glycol, propylene glycol, 1–3 butane diol and water.

When the smoke generation substance described above is used, smoke having a necessary concentration can be generated by raising the temperature to about 200° C. so as to quickly cause vaporization. Moreover, such a smoke generation substance does not contain petroleum components such as kerosine or mineral oils, and consequently, does not have any offensive odor and does not at all adversely affect the human body.

When the temperature is lowered, too, the problem of the precipitate impurities of the components and toxic materials remaining does not occur.

Figure 8:
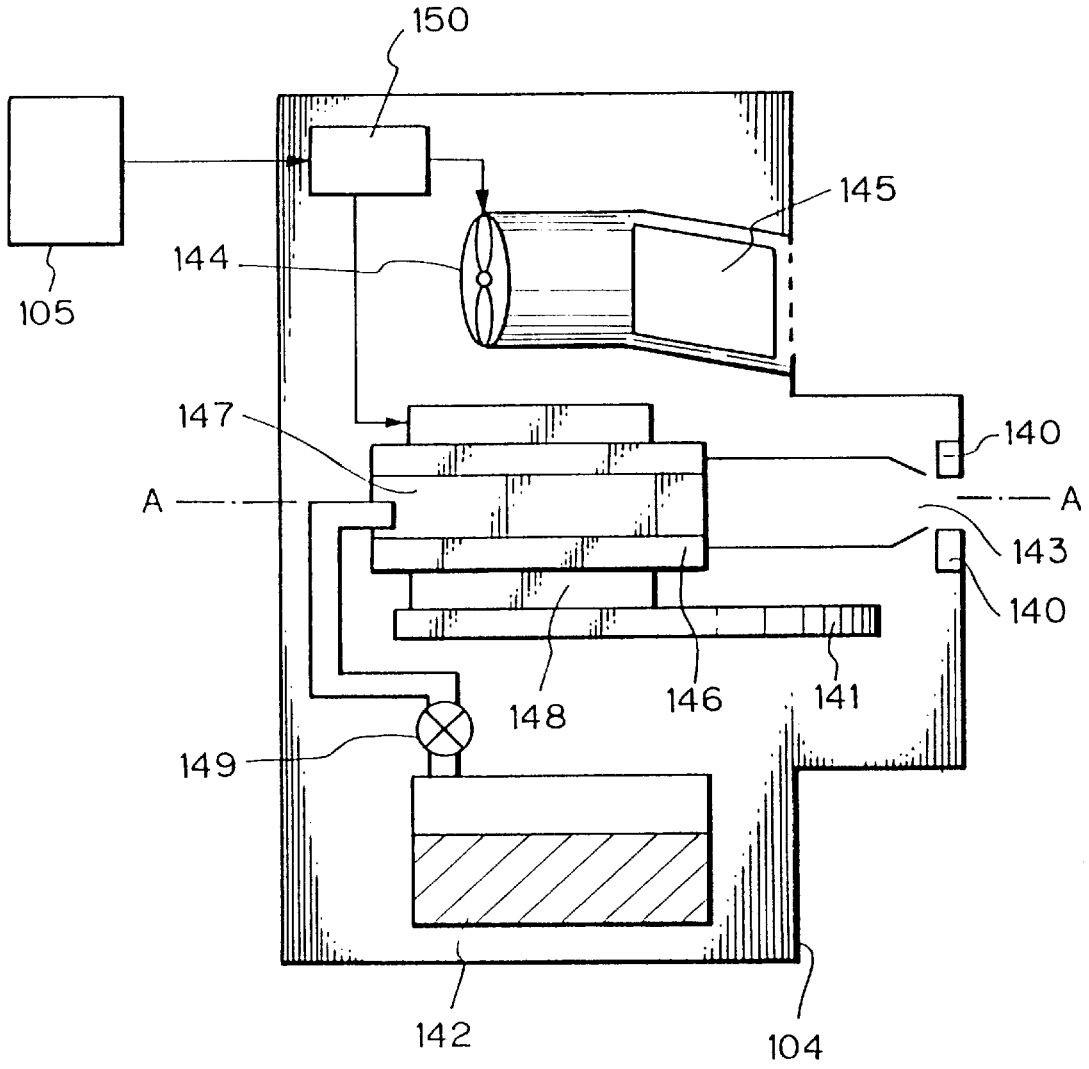
FIG. 8 is a block diagram showing a definite example of the construction of the emission means used in the second embodiment of the present invention.

FIG. 8 shows the outline of the structure of one definite example of the smoke generation means 104 used in the definite example of the invention described above. A storage portion 142 for storing a liquid as the smoke generation substance is installed inside the main body of the smoke generation means 104, and the smoke generation substance sucked up from this storage portion 142 by a liquid feed pump 149 is injected into a heating zone 147 comprising a suitable heating member 146 such as a ceramic heater, and vaporization and smoke generation are carried out there.

The heating member 146 is heated by suitable heating means 148 such as an electric heater.

The smoke generation substance which is vaporized and converted to smoke in the atomized state is jetted into the monitored area from a suitable nozzle portion 43 through a ventilator. Preferably, a fan 144, etc, is installed at the upper rear portion of the nozzle and a downward louver 145 is installed in front of the fan 144.

The direction of the louver 145 can be changed to the right and left and to up and down.

Since smoke is light in weight, it attempts to float up. However, air from the fan 144 flows downward through the louver 145. Therefore, smoke is preferably so guided as to immediately fill the monitored area 101.

In the present invention, when the moving object detection means 131, 132 detect the intruder and the smoke generation start signal is outputted through the control means 105 in response to this detection signal, it is essential to immediately generate the smoke by the smoke generation substance and to fill the monitored area 101 with this smoke. In other words, since the smoke generation substance must be quickly vaporized, it is preferred that the heating member 146 of the some generation means 104 is activated when the mode is set to the warning state, for example, or when the power source is turned ON, is always heated preliminarily, is sequentially heated to a predetermined vaporizable temperature and can undergo vaporization and atomization when the smoke generation start signal is outputted.

In other words, in order to quickly heat the smoke generation substance, the heating member 146 of the smoke generation means 104 of the present invention is preferably always heated up to the predetermined temperature. To this end, the heating member 146 preferably has a predetermined temperature sensor such as a thermistor.

Figure 9:
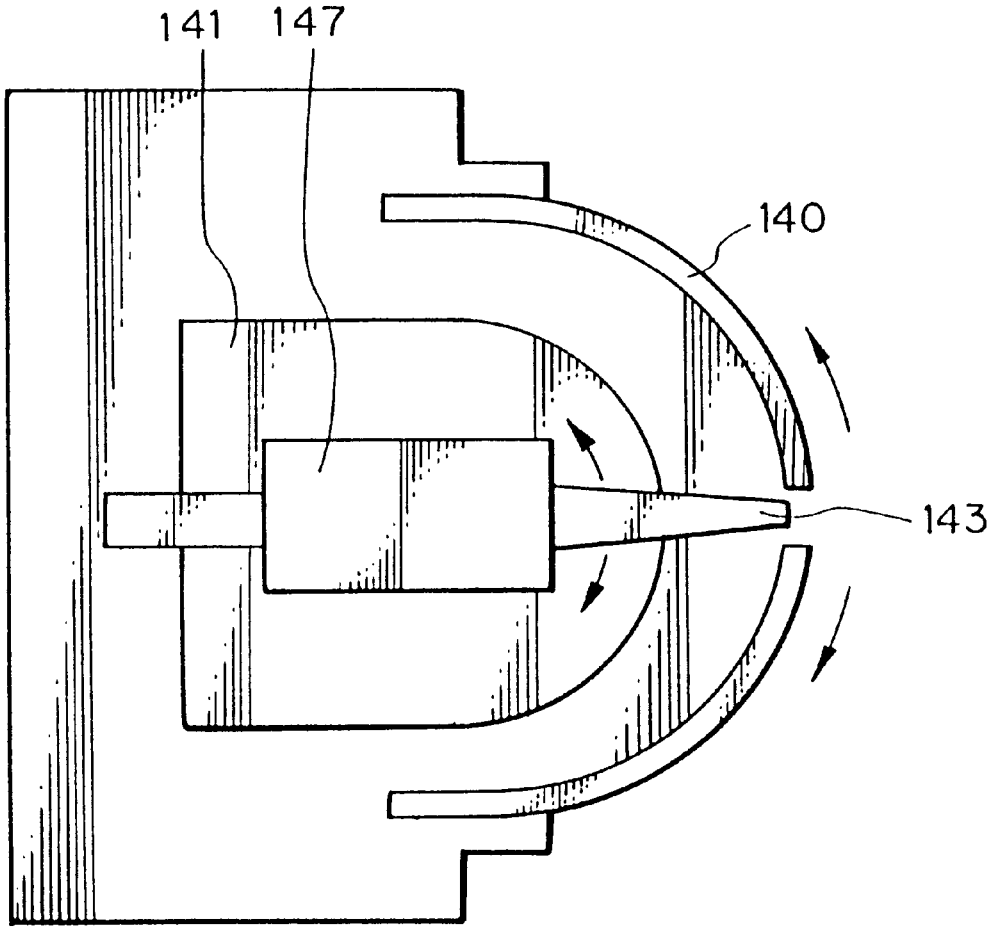
FIG. 9 is a block diagram showing a sectional view taken along a line A—A of FIG. 8.

FIG. 9 shows the outline of the structure of the smoke generation means 104 in the section taken along a line A—A.

The nozzle 143 is fixed to a rotary bed 141 with the heating member 146 and the heating means 148.

Accordingly, when the rotary bed 141 is turned to the right or left, the nozzle can be set to a suitable predetermined position.

A rotary front surface portion 140 equipped with ventilators is installed on the front surface of the nozzle 143 of smoke generation means 104.

After the position of the nozzle 143 is set, the ventilators are positioned so as to face the front surface of the nozzle 143 by rotating the front surface portion 140.

In the definite example shown in FIGS. 7 to 9, smoke in the atomized state blown out from the ventilators set in the state shown in the drawings has a high temperature and is blown with such force that even when the intruder bonds an adhesive tape to the front open portion of the nozzle 143 so as to cut off the smoke, the tape is immediately peeled off. Furthermore, the smoke generation means 104 is equipped with a gap portion (not shown in the drawings) besides the front open portion described above, and even when the intruder closes the open portion by any material, smoke is blown out from the gap portion. Accordingly, any attempt by the intruder to prevent smoke generation is actually waisted.

The smoke generation means 104 in the present invention is driven on the basis of the data from any of a plurality of moving object detection means 131, 132 installed inside the monitored area 101 and outside the monitored area 101, or the data from the antitheft sensors 133 to 136 installed at the entrance/exit 103 of the zone constituting the monitored area or on the windows, or the basis of the result of calculation of the combination of these data.

When the moving object detection means 131 and 132 no longer detect the existence of the intruder in the present invention, the control means 105 transmits a signal for stopping the smoke generation operation to the smoke generation means 104. As a result, the operation of the liquid feed pump 149 is stopped, the feed of the smoke generation substance to the heating member 146 is stopped, too, and heating by the heating member 146 drops to a temperature below the vaporization temperature of the smoke generation substance, thereby preventing the vaporization of the alcoholic components as the smoke generation substance. Accordingly, the fan 144 stops operating and blowout of smoke into the monitored area is prevented, too. There may be the case, for instance, where smoke during the smoke generation leaks from inside the monitored area 101 and a third party mistakes it as a fire. (The area is always locked during the warning mode.) It is therefore preferred to install smoke generation display means 107 at a suitable position around the outer periphery of the monitored area 101 so as to indicate that the smoke generation means is operating and generating smoke.

On the other hand, the intruder entrapped in the monitored area 101 and deprived of his free action might become destructive due to confusion and panic. It is therefore preferred in the present invention to install smoke generation announcement means 106, to announce that smoke generation means 104 is in operation, at a suitable position inside the monitored area 101 so as to inform the intruder by voice that the smoke generation means 104 is in operation.

In other words, both of the operation announcement means 106 and the operation display means 107 in the present invention use voice or image information.

Further, the smoke generation means in the present invention may be operated in an interlocking arrangement with the alarm means installed inside or outside the monitored area and may be connected to a Alarm center or to a police station.

The antitheft apparatus in the definite example of the present invention described above employs the technical construction also described above. Therefore, when the moving object detection means detect any moving object inside the monitored area, the smoke generation means vaporizes the smoke generation substance, which comprises the alcoholic components substantially harmless to the human body, to generate smoke by heating, fills the monitored area with this smoke, restricts the field of vision of the intruder, and brings the intruder into a helpless state in the monitored area. Eventually, the antitheft apparatus of the invention may make it possible to eventually arrest the intruder.

Since the front surface portion having the nozzle and the ventilators is rotatable, the antitheft apparatus of the present invention can be installed at an arbitrary position and can be used at such a position.

Furthermore, since the louver is so installed as to face downward, smoke does not expand upward immediately after it is blown out but is blown downward. Accordingly, smoke can fill the monitored area from the bottom up.

The antitheft apparatus in the definite example described above can fill the monitored area with smoke within a short time at the time of intrusion of the intruder, can cut off the field of vision of the intruder and can prevent theft and destruction by the intruder. However, smoke is generated consecutively even after his field of vision is cut off. Therefore, the monitored area is filled excessively with smoke, and there is the disadvantage that a long time is necessary before the field of vision is clear enough to arrest the intruder.

Accordingly, the third embodiment of the present invention demonstrates a further improved definite example of the antitheft apparatus described above, and is directed to provide a antitheft apparatus which starts the smoke generation on detecting the intruder such as the moving object inside the monitored area and which can control the smoke generation quantity of smoke jetted into the monitored area.

In other words, the third embodiment according to the present invention employs the following technical construction. The antitheft apparatus of this embodiment comprises, as one of its forms, moving object detection means, smoke generation means for jetting smoke in response to the output of the moving object detection means, and control means for controlling each of these means, wherein the control means includes counter means for counting the jetting time of smoke jetted from the smoke generation means, and means for reducing the jet quantity of smoke in accordance with the output signal of the counter means.

Another form of this antitheft apparatus comprises the moving object detection means, the smoke generation means for jetting smoke into the monitored area in response to the output of the moving object detection means, and the control means for controlling each of these means, wherein the control means include concentration detection means for detecting a concentration of smoke jetted into the monitored area, and means for regulating the jet quantity of smoke in accordance with the output signal of the concentration detection means.

The antitheft apparatus according to the third embodiment of the present invention employs the technical construction as described above. Therefore, when the moving object detection means detects any moving object, the smoke generation means generate smoke or a smoke-like atomized gas by heating and vaporizing the smoke generation substance consisting of, for example, alcoholic components as its principal components which are substantially harmless to the human body, fills the monitored area with this smoke, cuts off the field of vision of the intruder, and deprives the intruder of his free action inside the monitored area.

In this instance, the control means reduces the smoke generation quantity of the smoke generation means in accordance with the smoke generation time or increase the smoke generation quantity in accordance with the smoke concentration inside the monitored area so as to restrict excessive generation of smoke inside the monitored area. Accordingly, smoke filling the monitored area can be discharged and cleared up as soon as possible to allow the arrest of the intruder.

Hereinafter, definite examples of the antitheft apparatus according to the third embodiment of the present invention will be explained in detail with reference to the drawings.

The basic construction of the antitheft apparatus according to the third embodiment of the present invention has substantially the same construction as that of the construction of the definite examples shown in FIGS. 7 to 9. Therefore, the detailed description of the construction will be omitted, and control means 105 used in the third embodiment will be explained with reference to FIG. 10.

Figure 10:
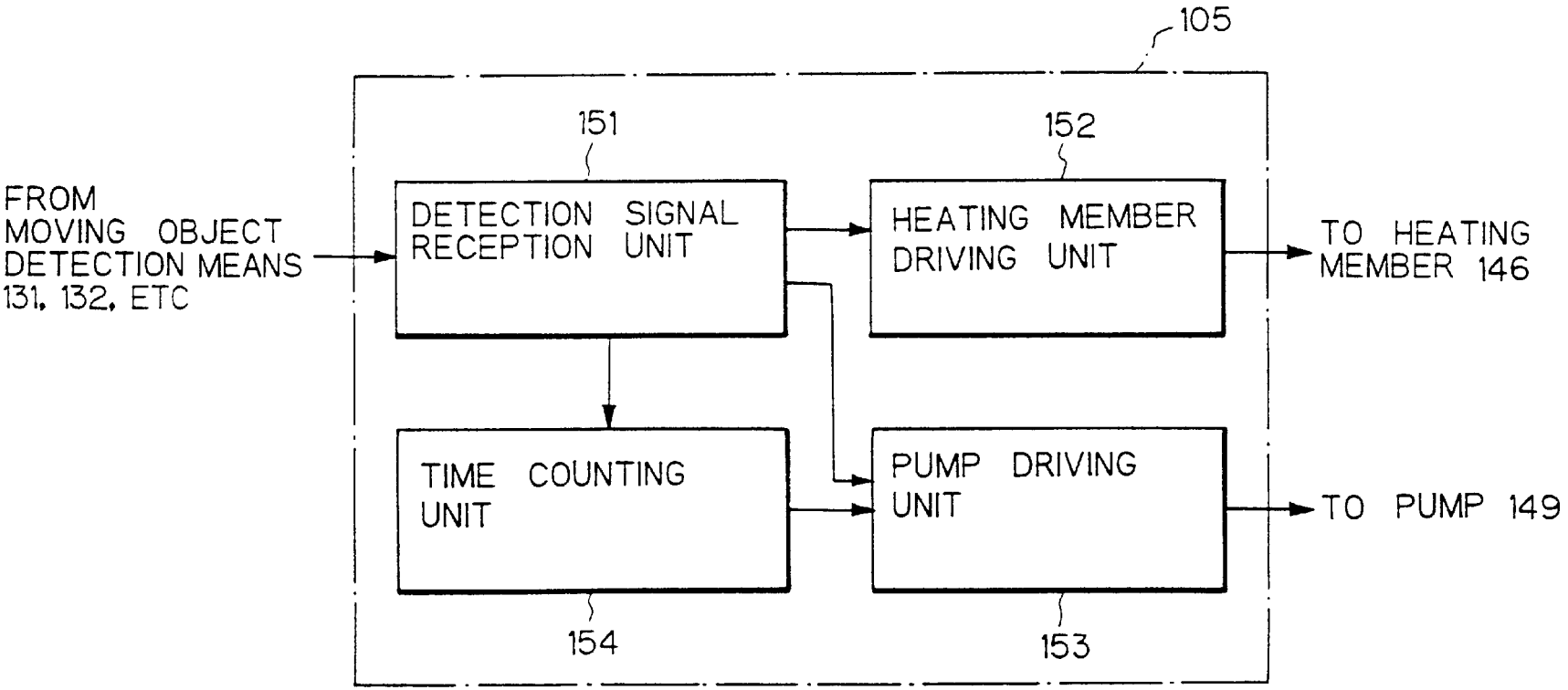
FIG. 10 is a block diagram showing a structural example of control means used in the antitheft apparatus according to a third embodiment of the present invention.

In FIG. 10, the control means 105 includes a detection signal reception unit 151, a heating member driving unit 152, a pump driving unit 153 and a counter unit 154.

When the moving object detecting means 131, 132 or the antitheft sensors 133 to 136 detect any intruder, the detection signal from each of these means is inputted to the detection signal reception unit 151. The detection signal reception unit 151 judges the state in accordance with a predetermined control program or sequence on the bases of such a detection signal. When the detection signal reception unit 151 judges the state as being abnormal, the reception unit 151 sends a heating control signal to the hearing member driving unit 152 so as to raise the temperature of the hearing member 146 to a predetermined temperature and a pump activation signal to the pump driving unit 153 so as to activate the liquid feed pump 149. In consequence, the smoke generation substance is fed to the heating member of the heating means and is vaporized, so that atomized smoke is jetted into the monitored area. At this time, the counter unit 154 counts the continuation time from the start of the activation of the pump.

When a predetermined time passes away, the counter unit 154 sends the limit signal of the pump operation to the pump driving unit 153, reduces the liquid feed quantity of the pump by changing the driving signal value to the pump 149, and limits the smoke generation quantity from the smoke generation means. Accordingly, it becomes possible to prevent an excessive quantity of smoke from filling the monitored area.

Figure 11:
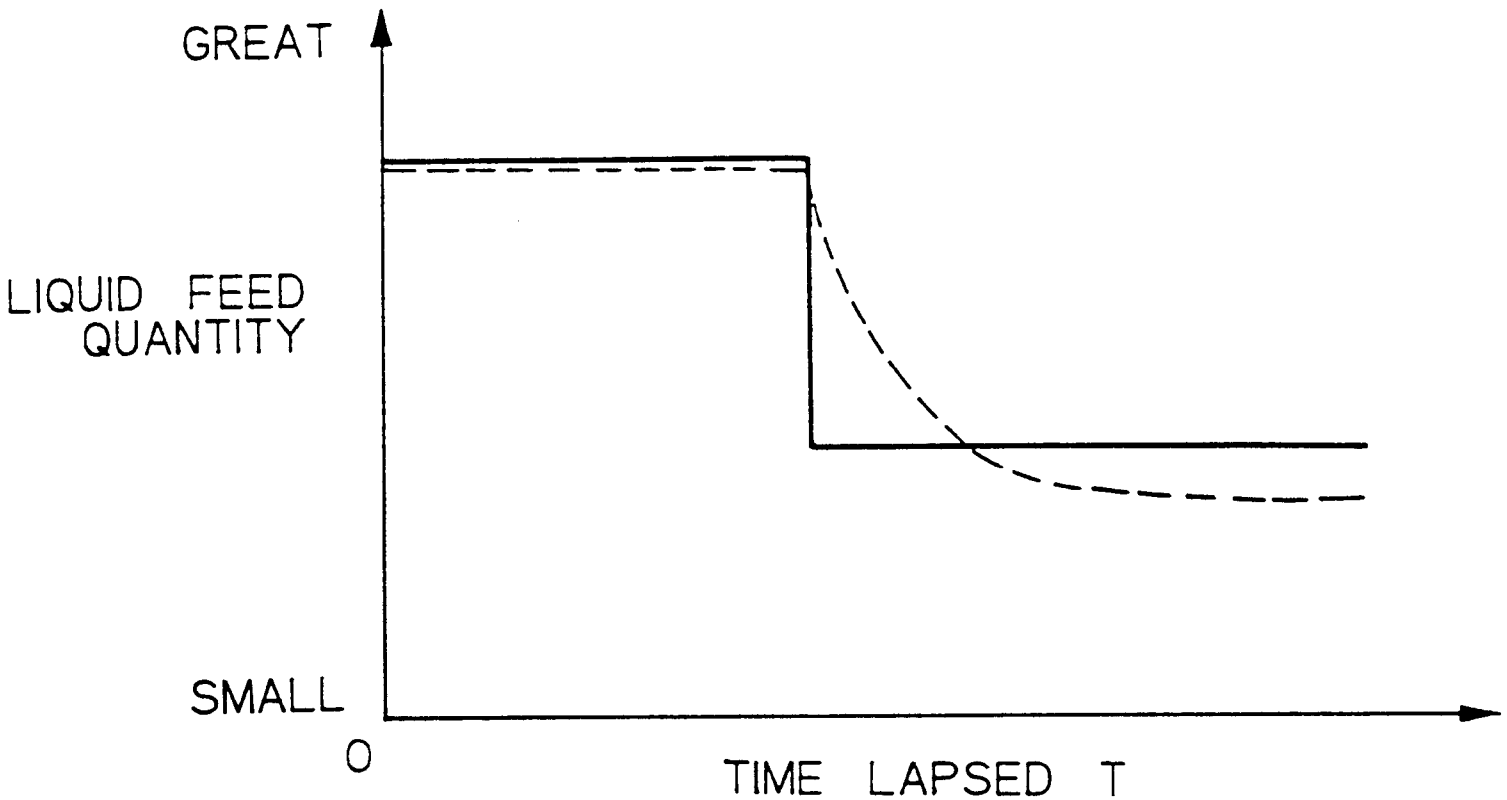
FIG. 11 is a diagram showing the relationship between a time lapsed of a pump used in the antitheft apparatus according to the third embodiment of the present invention and its liquid feed quantity.

In this embodiment, the counter unit 154 controls the pump driving unit 143 by a pulse signal simultaneously with the activation of the liquid feed pump 149 by the detection signal reception unit 151, and when the predetermined time passes, its duty ratio is changed either step-wise or continuously as shown in FIG. 11 so as to change the driving current of the pump and to reduce the liquid feed quantity of the smoke generation substance. However, it is also possible to install a valve in a path ranging from the pump 149 to the heating member 146 and to change the opening of this valve.

The predetermined time described above is determined as a preset design value in accordance with the scale or shape of the monitored area or with the properties of the smoke generation substance.

Figure 12:
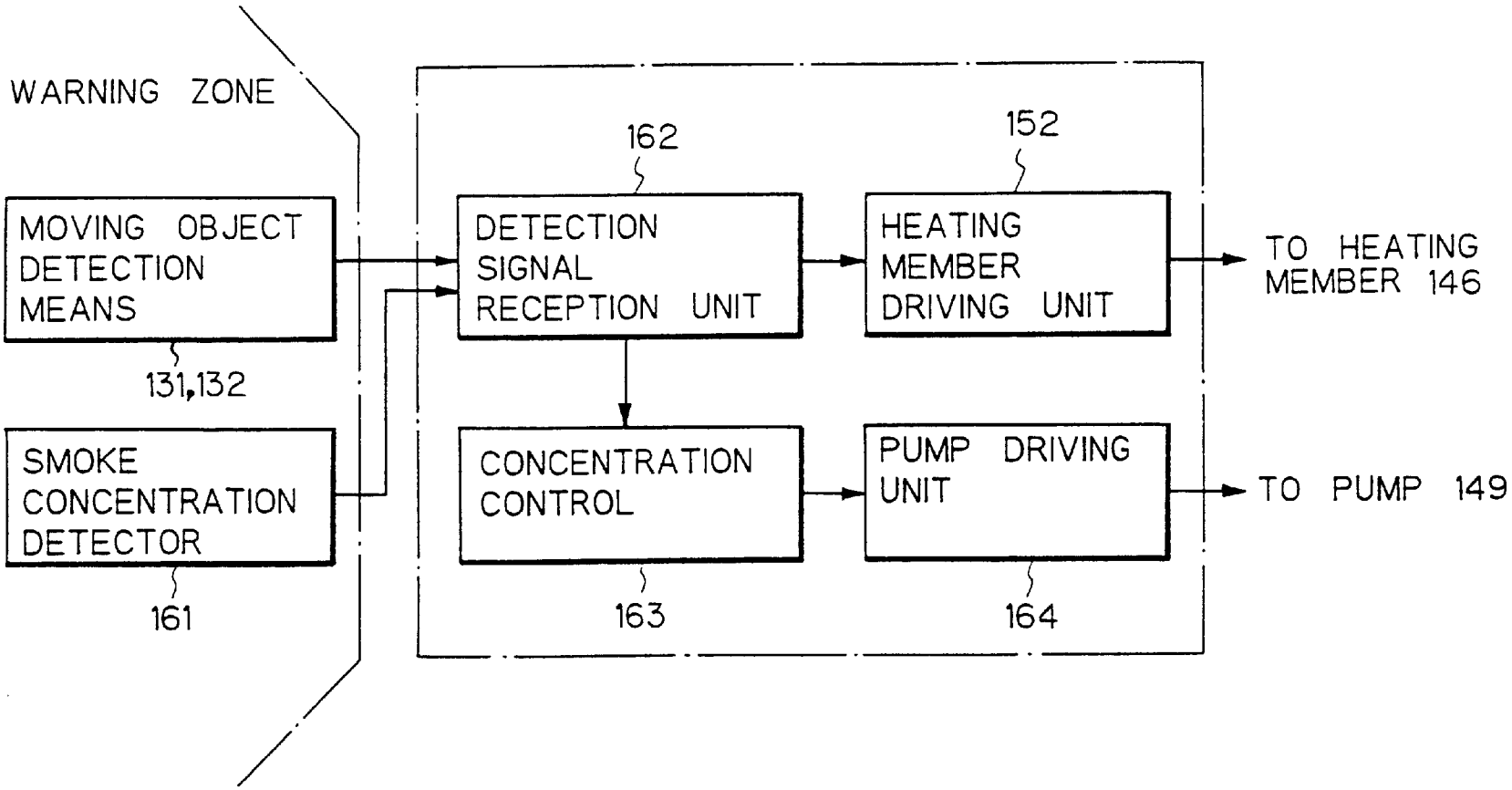
FIG. 12 is a block diagram showing another structural example of the control means used in the antitheft apparatus according to the third embodiment of the present invention.

Another control form of the control means 105 described above may be such that a smoke concentration detector 161 is further installed in the monitored area and is connected to the detection signal reception unit 162 such as the one shown in FIG. 12, the concentration control unit 163 sends the control signal to the pump driving unit 164 in accordance with the detected smoke concentration, and the feed quantity of the smoke generation substance is regulated by the pump driving signal the duty ratio of which is controlled as described above, for example, so as to fill the monitored area with the smoke having a predetermined smoke concentration.

In this case, the smoke concentration detector is installed at a suitable position inside the monitored area, and a conventional smoke sensor of a light scatter type, a smoke sensor of an infrared ray system comprising a projector and a receiver, or a duct housing type smoke sensor which sucks a predetermined area of the smoke inside the monitored area and measures the smoke concentration, can be used as the smoke concentration detector 161. Preferably, an analog signal system smoke sensor which quantitatively outputs the smoke concentration is used.

Though the explanation is given in the case where the smoke generation means and the control means are separate, for convenience sake, both of them may of course be integrated with each other.

The antitheft apparatus according to the third embodiment of the present invention employs the technical structure as described above. Therefore, when the moving object detection means detects any moving object, the smoke generation means heats and vaporizes the smoke generation means consisting primarily of the alcohol components substantially harmless to the human body to generate smoke and to fill the monitored area with smoke having a suitable concentration for cutting off the field of vision of the intruder. In this way, the intruder is deprived of his free action and, eventually, he can be quickly arrested by evacuating the smoke in the monitored area as soon as possible.

In the antitheft apparatus of each of the embodiments described above, the smoke generation means is activated upon detection of the intrusion of the intruder into a specific monitored area and fills the predetermined monitored area with predetermined smoke. However, there is the possibility that this smoke may be mistaken as a fire by a fire alarm installed separately for detecting the fire, and this problem must be solved.

Accordingly, in the antitheft apparatus which cuts off the field of vision of the intruder entering a specific monitored area and prevents theft by depriving the intruder of his free action, the forth embodiment of the present invention cancels the fire alarm output of the smoke sensor installed inside the monitored area so as to provide a antitheft apparatus which does not produce erroneous fire information.

To prevent the theft and/or destruction of money, precious articles, etc, in various buildings, conventional systems detect an intruder by suitable detection means installed at suitable positions inside a monitored area, emit a tear gas or a gas having offensive odor or generate smoke or vapor so as to generate a circumstance under which the intruder cannot stay, and let the intruder quickly leave the monitored area to prevent in advance the theft or destruction, as proposed by the foregoing embodiments.

However, there remains the problem that such a tear gas or a gas having an offensive odor activates a smoke sensor installed in the monitored area and causes it generate erroneous fire information.

In other words, the object of the fourth embodiment of the present invention is to provide a antitheft apparatus which solves the problem according to the prior art described above, which fills the monitored area with smoke to cut off the field of vision of the intruder when the intruder enters the monitored area, so as to prevent the theft and destruction, and cancels the fire generation signal of the smoke sensor installed in the monitored area so as to prevent the output of a fire generation signal when the fire does not occur.

To accomplish the object described above, the fourth embodiment of the present invention employs the following technical construction.

In the antitheft apparatus including a moving object detection means for detecting an intruder in an area and smoke generation means for generating smoke or a mist in the area, the antitheft apparatus according to the fourth embodiment of the present invention includes a smoke sensor for detecting a fire inside the monitored area, and cancellation means for canceling a first information signal of the smoke sensor when the smoke generation means operates in response to the detection output of the moving object detection means.

The antitheft apparatus according to this embodiment has the technical construction described above. Therefore, when the moving object detection means detects the intrusion of the intruder into the monitored area, the smoke generation means heats and vaporizes a smoke generation substance consisting primarily of alcoholic components which are substantially harmless to the human body, to generate smoke and fill the monitored area with smoke so that the field of vision of the intruder can be cut off and the intruder is deprived of his free action inside the monitored area. At the same time, the smoke sensor detects the occurrence of smoke and outputs the fire information signal, but such a fire information signal is canceled so that the erroneous generation of the occurrence of fire can be eliminated, and eventually, the intruder can be arrested.

Next, the definite example of the antitheft apparatus according to this embodiment will be explained in detail with reference to the drawings.

Figure 13:
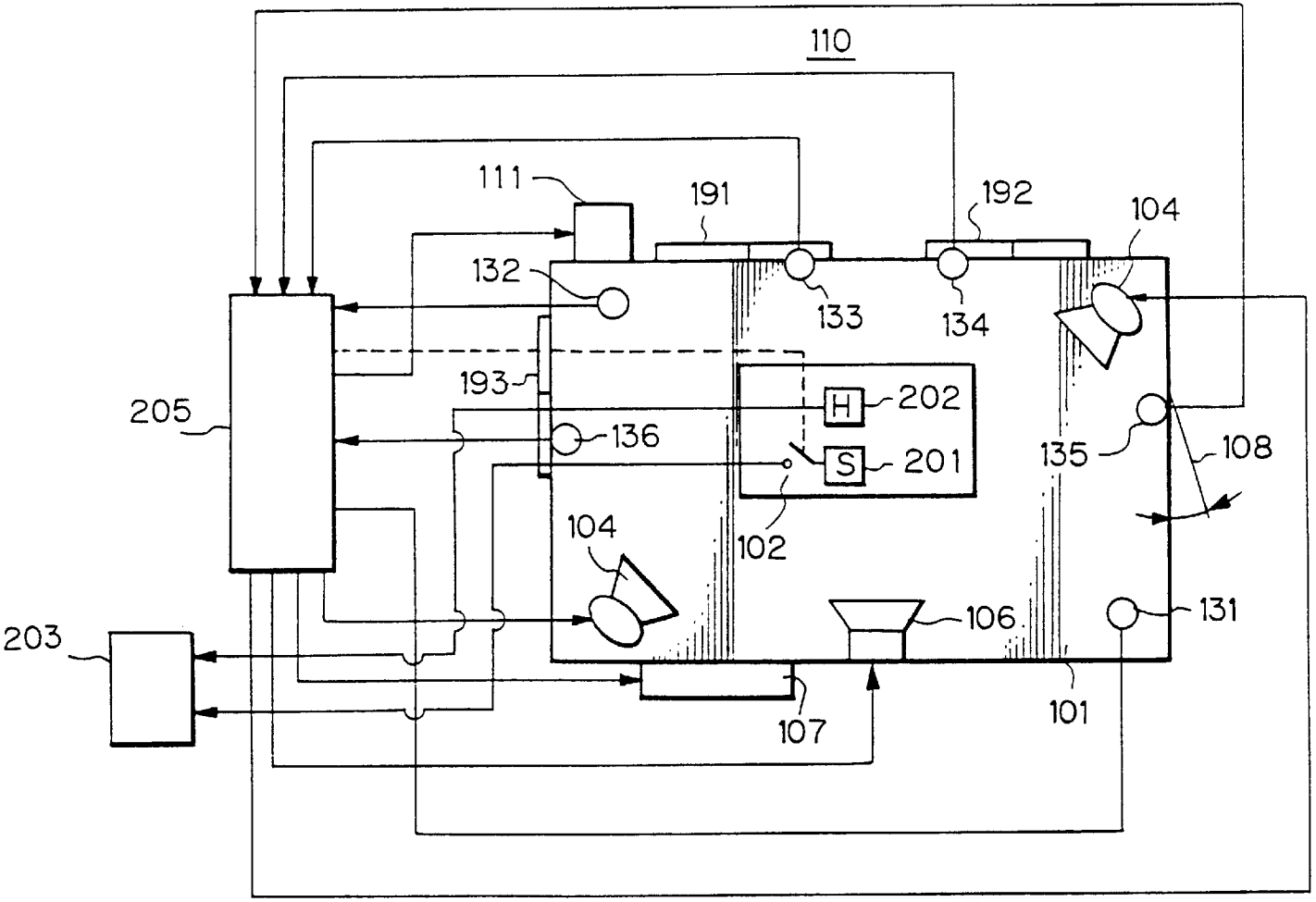
FIG. 13 is a block diagram showing an example of an overall system of the antitheft apparatus used in a fourth embodiment of the present invention.

FIG. 13 shows the construction of an example of the antitheft apparatus embodying the fourth embodiment of the present invention.

The basic construction of the antitheft apparatus according to the fourth embodiment of the present invention is substantially the same as that of the embodiment shown in FIGS. 7 to 9. Therefore, the definite explanation of the construction will be omitted and only different portions will be explained.

In other words, this embodiment discloses the antitheft apparatus including the smoke sensor 201 for detecting the fire inside the monitored area 101, installed in the monitored area 101, and the cancellation means for canceling the fire generation signal of the smoke sensor 201 when the smoke generation device 104 described above operates in response to the detection output of the moving object detection means 135 and 136.

In the antitheft apparatus according to this embodiment, objects to be guarded, such as expensive products e.g. a safe, precious metals, etc, and arts and crafts for exhibition, are installed inside the monitored area 101.

Windows 191, 192, 193 and entrance/exits 108 are installed in the monitored area 101, and known intruder detectors 133, 134, 135 and 136 are fitted to these windows 191, 192, 193 and entrance/exits 108.

When the moving object detection means 131, 132 detect the intruder, the control means 105 preferably sends intruder data to a remote warning center through an alarm device, not shown.

The antitheft apparatus further includes the moving object detection means 131, 132, the smoke generation device 104 for jetting smoke inside the monitored area in response to the outputs of the moving article detection means 131, 132 and of the moving object detection means 131, 132, and the control means 105 for controlling each of these means.

The smoke sensor 201 for detecting the occurrence of the fire by smoke and the heat sensor 202 for detecting the fire by hear are installed inside the monitored area 101.

In the antitheft apparatus having such a construction, the smoke sensor 201 is connected to a fire alarm panel 203 through a relay contact r1, for example, and the heat sensor 209 is directly connected to the fire alarm panel.

The fire alarm panel 203 may be installed either inside or outside the monitored area 101.

Next, the cancellation means used in the antitheft apparatus of the embodiment of the invention described above will be explained with reference to FIG. 14.

Figure 14:
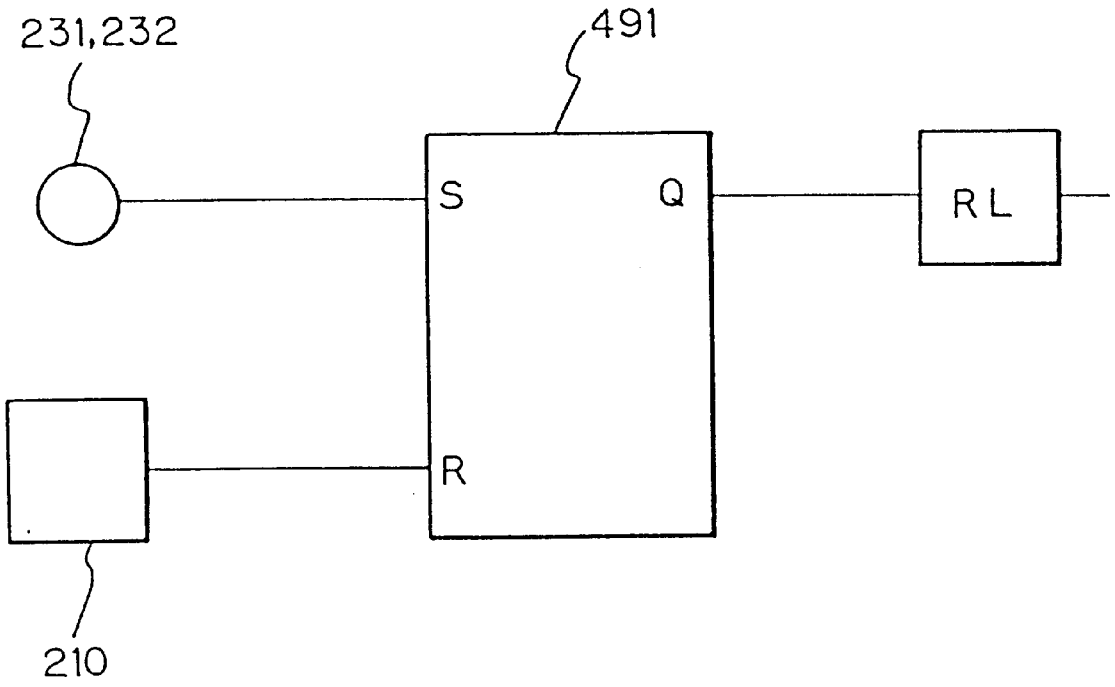
FIG. 14 is a block diagram showing an example of principal portions of control means of a smoke generation apparatus used in the antitheft apparatus according to the fourth embodiment of the present invention.

The smoke generator 104 includes the control means 205 for receiving the intruder detection signals of the moving object detection means 131, 132 as described above, and the control means 205 includes the flip-flop 491 for storing the intruder detection data and the relay r1 which operates when any signal input exists at the set terminal S of this flip-flop (refer to FIG. 14).

The reset button 210 for stopping the operation of the smoke generator 104 is connected to the reset terminal R of the flip-flop 491.

When the smoke is jetted into the monitored area 101 by this smoke generation means, the smoke sensor 201 operates even this smoke is not of smoke of the fire, due to the principle of the smoke sensor 201.

Accordingly, when the smoke generation means 104 receives the signals, which are outputted when the moving object detection means 131, 132 detect the intruder, and this smoke generation means 104 operates, the generation of the fire occurrence signal or the signal from the smoke sensor 201 must be cancelled.

To this end, according to the present invention, when the intruder detection signals of the moving object detection means 131, 132 are inputted to the set terminal S of the flip-flop 491, the relay r1 operates as shown in FIGS. 13 and 14 and is opened in which a manner as to cut OFF the signal between the smoke sensor 208 and the fire alarm panel 203, so that the report of the fire occurrence signal outputted from the smoke sensor 201 to the fire alarm panel 203 is cancelled.

By the way, another definite example according to the fourth embodiment of the present invention uses the heat sensor 202 in combination with the smoke sensor 201. Therefore, if the intruder sets fire, the heat sensor 202 reliably detects such fire. Accordingly, the detection of the intruder and the detection of the occurrence of fire can be detected simultaneously and accurately.

In this way, it becomes possible to prevent a false report that there is no fire.

Needless to say, the smoke sensor 201 and the heat sensor 202 may be of an integral composite fire sensor in the present invention.

In this embodiment, the signal line between the smoke sensor 201 and the fire alarm panel 203 is cut off, but the portion of the in terminal of the fire alarm panel for receiving the fire signal of the smoke sensor 201 may be cut off, as well.

In other words, the fire signal of the smoke sensor 201 during the operation of the smoke generation means 104 can be cancelled by the cancellation means in the present invention and it is also possible to employ the construction in which the fire alarm panel 203 cannot detect the occurrence of fire.

The cancellation means in the present invention may use the circuit constructions other than the construction using the flip-flop circuit 491 in the control circuit 105 described above, and a control circuit employing any circuit construction can be used so long as the function described above can be accomplished.

The circuit which is controlled by the flip-flop circuit 491 of the cancellation means in the present invention is not particularly limited to the relay r1, but any circuit construction can be used so long as it has the functions capable for interrupting the occurrence of the fire signal from the smoke sensor 201 and cutting off the line for reporting the fire signal to the fire alarm panel 203.

The antitheft apparatus according to the fourth embodiment of the present invention employs the technical construction such as described above. Therefore, when the moving object detection means detect the intrusion of the intruder into the monitored area 101, the smoke generator heats and vaporizes the smoke generation substance consisting primarily of the alcoholic components which are substantially harmless to the human body, generates atomized smoke and fills the monitored area with this smoke so as to cut off the field of vision of the intruder. On the other hand, the apparatus of this invention cancels the fire occurrence signal for the smoke sensor and prevents the generation of a false fire signal. Eventually, the apparatus of the present invention may result in the arrest of the intruder.

What is claimed is:

1. An antitheft apparatus comprising:

intruder detectors for detecting an intrusion by an intruder into a monitored area; and a smoke generator for generating smoke or an atomized smoke-like gas inside said monitored area;

wherein a smoke sensor for detecting fire inside said monitored area is installed in said monitored area, and said apparatus includes cancellation means for canceling a fire occurrence signal of said smoke sensor when said smoke generator operates in response to the detection output of said intruder detector.

2. An antitheft apparatus according to claim 1, wherein said cancellation means comprises a relay.

3. An anti-theft apparatus according to claim 1, further comprising:

a mode setter for setting at least first and second states of said monitored area;

a smoke generation starting means for operating said smoke generating means when said mode setter is set to said first state and said intrusion detector detects an intrusion and for not operating said smoke generating means when said mode setter is set to said second state and said intruder detector detects an intrusion; and an alarm means connected to said intrusion detector, said smoke generation starting means, said mode setter and an alarm center, said alarm means for sending a signal to said alarm center a) when said intrusion detector detects an intrusion and said mode setter is in said first state and b) when said smoke generation starting means operates said smoke generating means.

4. An antitheft system according to claim 3, which includes time counting means which operates when said intruder detector detects the intrusion and a release device installed inside said monitored area, and wherein said smoke generation starting means causes the smoke generator to generate smoke inside said monitored area when a release operation is not effected by a release device within a predetermined period of time.

5. An antitheft system as claimed in claims 2, 3 or 4, which further includes:

warning means for warning an intruder;

warning control means for operating said warning means when said intruder detector detects the intruder; and a detector for detecting the intruder inside said monitored area; and wherein:

said smoke generation starting means causes the smoke generator to generate smoke when said detector confirms the existence of the intruder after said warning device starts operating.

6. An antitheft device apparatus as claimed in claims 3 or 4 comprising:

moving object detection means installed inside a monitored area;

smoke generation means for jetting smoke into said monitored area in response to the output of said moving object detection means; and control means for controlling each of said means; and wherein said smoke generating means has the function of generating smoke by vaporizing components which are to be converted to smoke.

7. An antitheft apparatus according to claim 6, wherein said smoke generation means includes storage means for storing smoke generation components and heating means for heating said smoke generation components.

8. An antitheft apparatus according to claim 6, wherein said smoke generation means includes a stationary supporting means for rendering a nozzle for jetting smoke movable.

9. An antitheft apparatus according to claim 6, wherein said smoke generation means include a front surface portion for rendering smoke vents movable.

10. An antitheft apparatus according to claim 6, wherein said smoke generation means further includes draft means.

11. An antitheft apparatus according to claim 10, wherein said smoke generation means includes a louver for sending downward air from said draft means.

12. An antitheft apparatus according to claim 3 further comprising:

control means for controlling each of said intrusion detectors and smoke generating means; and wherein said control means includes time counting means for counting a lapse time of smoke jetted from said smoke generating means, and reducing means for reducing continuously the quantity of smoke by an output signal of said time counting means.

13. An antitheft apparatus according to claim 3 further comprising:

control means for controlling each of said intrusion detectors and smoke generating means; and wherein said control means includes concentration detection means for detecting concentration of smoke jetted into said monitored area, and means for changing a quantity of smoke jetting in accordance with an output signal of said concentration detection means to maintain a predetermined smoke concentration.

14. An apparatus according to claim 3, Therein the modes to be set by said mode setter includes at least a mode of warning and manned state, a mode of warning and no-man state, and a mode of a warning-release state.

15. An anti-theft system according to claim 3, wherein said alarm center is located remote from said alarm means, said alarm center including a monitoring device connected with an alarm generation circuit provided in said alarm means through a communication line, a signal representing the activation of smoke generation being sent from the alarm generation circuit to the monitor device.

16. An anti-theft system according to claim 3, further comprising activation means for activating said smoke generation starting means irrespective of a state set by said mode setter.

17. An anti-theft system according to claim 3, which further includes a report device for sending a signal to the alarm center and confirmation means for confirming the operation of said smoke generating means, and wherein said report device sends an intruder signal to said alarm center when said confirmation means detects the generation of smoke.

18. An antitheft system according to claim 1, which further includes time counting means which operates upon the operation of said smoke generation starting means, and wherein said smoke generating means is again operated when said confirmation means does not detect the generation of smoke by said smoke generating means during counting by said time counting means.

* * * * *